US005749029A

United States Patent [19]

Umeda

[11] Patent Number: 5,749,029

[45] Date of Patent: May 5, 1998

[54] ELECTROPHOTOGRAPHIC PROCESS AND APPARATUS THEREFOR

[75] Inventor: Minoru Umeda, Numazu, Japan

[73] Assignee: Ricoh Company, Ltd., Tokyo, Japan

[21] Appl. No.: 744,834

[22] Filed: Nov. 6, 1996

[30] Foreign Application Priority Data

Nov. 6, 1995 [JP] Japan ..... 7-309752
Oct. 24, 1996 [JP] Japan ..... 8-299243

[51] Int. Cl.[6] ..... G03G 15/04; G03G 21/00

[52] U.S. Cl. ..... 399/128; 399/220; 430/31

[58] Field of Search ..... 399/128, 220, 399/221, 51; 430/31

[56] References Cited

U.S. PATENT DOCUMENTS 4,533,232 8/1985 Fujimura et al. ..... 399/221

FOREIGN PATENT DOCUMENTS 57-97549 6/1982 Japan .
7-219257 8/1995 Japan .

*Primary Examiner*—Joan H. Pendegrass
*Attorney, Agent, or Firm*—Oblon, Spivak, McClelland, Maier & Neustadt, P.C.

[57] ABSTRACT

In an electrophotographic process using an electrophotographic photoconductor having a photoconductive layer which contains a charge generation material and a charge transport material, the charge transport material being convertible from a neutral state into a charged state during the photoconduction in the photoconductive layer, when light is applied to the photoconductive layer, there is employed at least one type of rays of light selected from type 1 which has a light emission peak, and type 2 and type 3, each of which has a continuous spectrum with a threshold wavelength value, in such a manner that a half-width wavelength range of type 1 does not overlap a peak wavelength or a half-width wavelength range of an absorption peak of the charge transport material in the charged state, and a half value of a threshold wavelength value of each of type 2 or type 3 is beyond the wavelength or a half-width wavelength range of any of extreme end absorption peaks in terms of the wavelength of the absorption light of the charge transport material in the charged state, and an electrophotographic apparatus for performing the electrophotographic process is provided.

30 Claims, 8 Drawing Sheets

ELECTROPHOTOGRAPHIC PROCESS AND APPARATUS THEREFOR

BACKGROUND OF THE INVENTION

1. Field of the Invention

The present invention relates to an electrophotographic process using an electrophotographic photoconductor comprising a photoconductive layer which comprises a charge generation material (CGM) and a charge transport material (CTM), by which process the above-mentioned electrophotographic photoconductor can be prevented from deteriorating in terms of the electrostatic properties, that is, the decrease of chargeability and the increase of residual potential during the repeated operations for an extended period of time. In addition, the present invention also relates to an electrophotographic apparatus for achieving the above-mentioned electrophotographic process.

2. Discussion of Background

The Carlson process, and other modified processes thereof are conventionally known as the electrophotographic processes, which are widely employed in a variety of electrophotographic apparatuses such as a copying machine and a printer. In such electrophotographic apparatuses, an organic electrophotographic photoconductor comprising an organic photoconductive material is mainly used because the manufacturing cost can be reduced, the productivity can be increased, and environmental pollution can be prevented.

With respect to the organic photoconductive material, there are known a photoconductive resin such as polyvinylcarbazole (PVK); a charge transport complex such as PVK-TNF (2,4,7-trinitrofluorenone); a pigment-dispersed material such as a phthalocyanine binder; and a function separating photoconductive material composed of a charge generation material and a charge transport material. In particular, the organic photoconductor of a function-separating type has become the mainstream because of its excellent photosensitivity and high speed response performance which are comparable to those of the inorganic photoconductor. The organic photoconductive layer comprising a CGM exhibiting an absorption peak mainly in the range from the visible light region through the near infrared region, and a CTM exhibiting absorption peaks mainly in the ultraviolet region is well known and considered to be remarkably useful.

When the electrophotographic process is carried out using the organic electrophotographic photoconductor of a function separating type, the photoconductor is charged so as to have a predetermined surface potential in the dark, and the charged photoconductor is exposed to light images. At the step of exposing the photoconductor to light images, the light passes through a transparent charge transport layer and is absorbed by the CGM in the charge generation layer. The CGM absorbs the light, thereby generating a charge carrier. The charge carrier thus generated is injected into the charge transport layer, and moves in the charge transport layer along the electric field generated by the charging step, and finally arrives at the surface portion of the photoconductor to neutralize the surface charge. Thus, latent electrostatic images are formed on the surface of the photoconductor corresponding to the light images.

However, the organic photoconductor of a function-separating type has the drawbacks that the chargeability of the photoconductor is decreased and the residual potential is increased during the repeated electrophotographic operations although this kind of photoconductor has the advantages of high photosensitivity and high-speed response performance as previously mentioned.

According to the electrophotographic process disclosed in Japanese Laid-Open Patent Application 55-67778, when the photoconductive layer with a predetermined surface potential is exposed to light images to form latent electrostatic images on the photoconductive layer, and the residual charges are quenched from the surface of the photoconductive layer, the rays of light applied to the surface of the photoconductive layer are controlled so as not to include any absorption light of the employed CTM in a neutral state. Thus, the decrease of chargeability and the increase of residual potential of the photoconductor can be minimized, so that the fatigue of the photoconductive properties with time can be improved to some extent.

Further, there is also proposed a method for preventing the decrease of chargeability and the increase of residual potential of the photoconductor in Japanese Laid-Open Patent Application 63-4264. According to this method, a charge generation material for use in the photoconductive layer exhibits at least two absorption peaks, and it is proposed to apply the ray of light whose peak wavelength is longer than the wavelength of the rightmost absorption peak of the charge generation material, on a scale with the wavelength increasing in the right direction, to the surface of the photoconductive layer at the step of exposing the photoconductive layer to light images to form latent electrostatic images thereon. By this method, however, the change of the photoconductive properties with time cannot be sufficiently prevented.

In addition, there is described in Japanese Laid-Open Patent Application 57-8550 that when a photoconductive layer comprises a specific disazo pigment, the rays of light with a wave range of 460 to 700 nm is applied to the surface of the photoconductive layer at all the light-application steps, or a part of the above-mentioned light-application steps. By this method, the electrostatic fatigue of the photoconductor can be reduced, so that high quality images can be constantly obtained. However, the durability of the photoconductor cannot be sufficiently improved in practice.

The cause of the above-mentioned electrostatic fatigue behavior of the organic photoconductor has not been clarified, and a decisive countermeasure has not been taken to solve the above-mentioned problem. As long as the fatigue behavior of the photoconductor during the repeated operations remains unsolved, it is impossible to complete the electrophotographic process capable of maintaining high photosensitivity, without the decrease of chargeability and the increase of residual potential.

SUMMARY OF THE INVENTION

It is therefore a first object of the present invention to provide an electrophotographic process using an electrophotographic photoconductor, by which process the photoconductor can maintain high photosensitivity, and excellent durability without the decrease of chargeability and the increase of residual potential during the repeated operations for an extended period of time.

A second object of the present invention is to provide an electrophotographic apparatus capable of achieving the above-mentioned electrophotographic process.

The first object of the present invention can be achieved by an electrophotographic process using an electrophotographic photoconductor comprising a photoconductive layer which comprises a charge generation material and a charge transport material, the charge transport material being convertible from a neutral state into a charged state during the photoconduction in the photoconductive layer, comprising the steps of charging the photoconductive layer so as to have a predetermined surface potential in the dark; exposing the photoconductive layer with the predetermined surface potential to light images to form latent electrostatic images thereon; developing the latent electrostatic images with a toner to visible toner images; transferring the visible toner images to an image transfer sheet; cleaning the photoconductive layer to remove residual toner particles from the surface of the photoconductive layer; and quenching residual charges from the surface of the photoconductive layer, wherein when light is applied to the photoconductive layer in the course of the electrophotographic process, at least one type of rays of light selected from type 1, type 2 and type 3 is employed, that is, type 1 is the rays of light having a light emission peak, with a half-width wavelength range thereof being free from the overlapping of a peak wavelength of an absorption light of the charge transport material in the charged state; type 2 is the rays of light with a continuous spectrum having a threshold wavelength value, with the light emission components thereof being present on a longer wavelength side than the threshold wavelength value, and on a scale with the wavelength increasing in the right direction, a half value of the threshold wavelength value being on a longer wavelength side beyond the wavelength of a rightmost absorption peak of an absorption light of the charge transport material in the charged state; and type 3 is the rays of light with a continuous spectrum having a threshold wavelength value, with the light emission components thereof being present on a shorter wavelength side than the threshold wavelength value, and on a scale with the wavelength decreasing in the left direction, a half value of the threshold wavelength value being on a shorter wavelength side beyond the wavelength of a leftmost absorption peak of an absorption light of the charge transport material in the charged state, in a wavelength range free from the overlapping of the light absorption of the charge transport material in the neutral state and the light absorption of the charge transport material in the charged state.

The second object of the present invention can be achieved by an electrophotographic apparatus comprising an electrophotographic photoconductor comprising a photoconductive layer which comprises a charge generation material and a charge transport material, the charge transport material being convertible from a neutral state into a charged state during the photoconduction in the photoconductive layer, charging means for charging the photoconductive layer so as to have a predetermined surface potential in the dark, exposure means for exposing the photoconductive layer with the predetermined surface potential to light images to form latent electrostatic images thereon, developing means for developing the latent electrostatic images with a toner to visible toner images, image transfer means for transferring the visible toner images to an image transfer sheet, cleaning means for cleaning the photoconductive layer to remove residual toner particles from the surface of the photoconductive layer, and quenching means for quenching residual charges from the surface of the photoconductive layer, wherein when light is applied to the photoconductive layer in the electrophotographic apparatus, at least one type of rays of light selected from the above-mentioned type 1, type 2 and type 3 is employed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
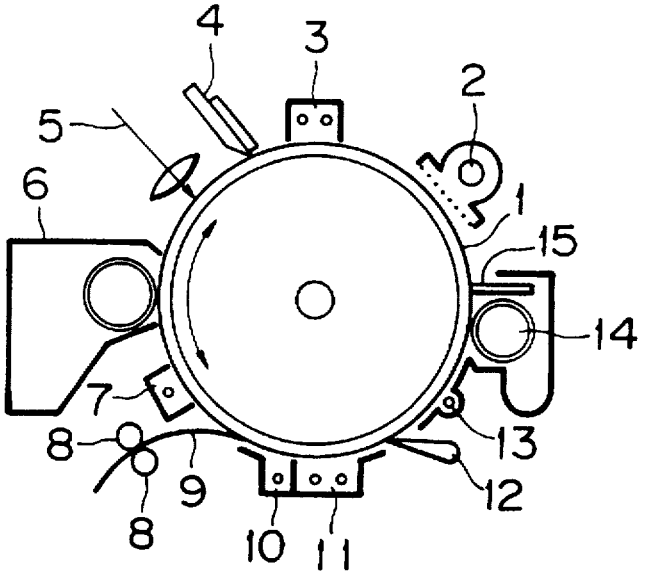
FIG. 1 is a schematic diagram which shows one example of the electrophotographic process and apparatus according to the present invention.

The inventor of the present invention has intensively investigated into the problem that the chargeability of the organic electrophotographic photoconductor is decreased and the residual potential of the photoconductor is increased during the repeated operations from the aspect of photochemical reaction and deterioration of a charge transport material employed in the photoconductor. As a result, it has been found that the light absorption of the charge transport material in a charged state is closely connected with the electrostatic fatigue of the photoconductor, that is, the decrease of chargeability and the increase of residual potential in the organic photoconductor of a function-separating type.

The electrostatic fatigue of the organic photoconductor of a function-separating type is regarded as a phenomenon caused by a nonreversible reaction. Therefore, it is considered that an approach from the nonreversible reaction of the organic photoconductive material is proper to solve the problem of the electrostatic fatigue.

As previously explained, when the organic function-separating type photoconductor which has been charged to a predetermined surface potential is exposed to light images, the light is not absorbed by the CTM in the charge transport layer, but absorbed by the CGM in the charge generation layer. The CGM absorbs the light, thereby generating a charge carrier. The charge carrier thus generated is injected into the charge transport layer, and moves in the charge transport layer along the electric field generated by the charging step, and finally arrives at the surface portion of the photoconductor to neutralize the surface charge. Thus, latent electrostatic images are formed on the surface of the photoconductor.

The transportation of a charge in the charge transport layer is based on a so-called hopping conduction mechanism. Namely, the charge goes from one molecule of the CTM in a charged state to another neighboring molecule thereof which is in a neutral state. When the CTM is a positive-hole transport material, the CTM becomes a cation radical in a charged state; while the CTM is an electron transport material, the CTM becomes an anion radical.

In general, the CTM in a neutral state does not exhibit its absorption in the visible region. Once the CTM assumes a charged state, the CTM absorbs the light in the range from the visible region to the infrared region. When the CTM is charged to assume a cation or anion radical state, the CTM becomes considerably unstable to such a degree that it cannot be isolated. Therefore, when the charged CTM is repeatedly exposed to the light throughout the electrophotographic process, it absorbs the light within the range from the visible region to the infrared region. Thus, the electron transition takes place, and at nonreversible decomposition reaction of the CTM gradually proceeds. Consequently, the capability of the CTM to transport the electric charge may be degraded.

With the above-mentioned mechanism taken into consideration, the inventor of the present invention has studied the light absorption of the CTM in the charged state in connection with the increase of chargeability and the decrease of residual potential of the organic photoconductor of a function-separating type.

FIG. 1 is a schematic diagram which shows one example of the electrophotographic process and apparatus according to the present invention.

As shown in FIG. 1, a quenching light exposure unit 2, an electrical charger 3, an eraser 4, an image recording light exposure unit 5, a developing unit 6, pre-transfer charger 7, a transfer charger 10, a separating charger 11, a separating claw 12, a pre-cleaning charger 13, a fur brush 14, and a cleaning brush 15 are disposed in the counterclockwise direction around a photoconductor drum 1 in such a fashion that each unit is brought into the immediate proximity of the photoconductor drum 1. Further, a pair of resist rollers 8 is disposed so as to send an image transfer sheet 9 into a gap between the photoconductor drum 1 and the transfer charger 10. The photoconductor drum 1 comprises an electroconductive support and a photoconductive layer formed thereon, and is driven in rotation in a counterclockwise direction (in the direction of an arrow).

By the electrophotographic process as illustrated in FIG. 1, as the photoconductor drum 1 is rotated in a counterclockwise direction, the photoconductor drum 1 is positively or negatively charged by the electrical charger 3, and residual toner particles deposited on the surface of the photoconductor drum 1 are removed therefrom by the eraser 4, and then, the surface of the photoconductor drum 1 is exposed to light images using the image recording light exposure unit 5. Thus, latent electrostatic images are formed on the surface of the photoconductor drum 1. The thus formed latent electrostatic images are developed to visible toner images in such a manner that toner particles are deposited on the latent electrostatic images using the developing unit 6. The charged, condition of the toner images formed on the photoconductor drum 1 is adjusted using the pre-transfer charger 7, and the toner images are transferred to the image transfer sheet 9 using the transfer charger 10. Then, the transfer sheet 9 is electrostatically stripped from the photoconductor drum 1 using the separating charger 11 and physically separated therefrom by means of the separating claw 12. After the transfer sheet 9 is separated from the photoconductor drum 1, the surface of the photoconductor drum 1 is cleaned off using the pre-cleaning charger 13, the fur brush 14 and the cleaning brush 15. The above-mentioned cleaning operation may be carried out by removing the toner particles remaining on the surface of the photoconductor drum 1 only using the cleaning brush 15.

In the case where the positively or negatively charged photoconductor drum 1 in exposed to light images, positive or negative latent electrostatic images are formed on the photoconductor drum 1. When the thus formed positive or negative latent electrostatic images are developed using a negatively or positively charged toner, that is, a toner with a polarity different from that of the latent electrostatic images, positive images can be obtained. In contrast to this, negative images can be obtained using a toner with the same polarity as that of the latent electrostatic images. Such a development operation and a quenching operation can be carried out in the conventional manner.

In the electrophotographic apparatus as shown in FIG. 1, the photoconductor is in the form of a drum. In addition to this, a sheet-shaped or endless belt photoconductor is usable in the present invention.

The pre-cleaning charger 13 may employ any conventional charging means such as a corotron, scorotron, solid state charger, or charging roller. Such a conventional charging means may also be used for the transfer charger 10 and separating charger 11. In particular, it is efficient that the transfer charger 10 be integral with the separating charger 11 as shown in FIG. 1. For the cleaning brush 15, any conventional material for the cleaning brush such as a fur brush or magnetic brush may be employed.

As a light source for the image recording light exposure unit 5 and the quenching light exposure unit 2, there can be employed a fluorescent light, tungsten light, halogen lamp, mercury vapor lamp, sodium lamp, light emitting diode (LED), semiconductor laser (LD) and electroluminescence (EL). In the present invention, the rays of light emitting from the above-mentioned conventional light source may be caused to pass through a variety of filters such as a sharp cut filter, band pass filter, near-infrared cut filter, dichroic filter, interference filter and conversion filter for color temperature, so that the rays of light with a desired wavelength range can be obtained.

The above-mentioned combination of the light source and filter may also be used when light is applied to the photoconductor using other units, for example, a pre-image recording light exposure unit, pre-transfer light exposure unit, and pre-cleaning light exposure unit (not shown in FIG. 1).

As previously mentioned, the photoconductor for use in the present invention is subjected to light exposure a plurality of times. For example, after the photoconductor drum 1 is exposed to light images to form latent electrostatic images thereon using the image recording light exposure unit 5, the light is again applied to the photoconductor drum 1 using the quenching light exposure unit 2. When the light applied to the photoconductor does not include any absorption light of the employed CTM in a charged state, or the quantity of light not including any absorption light of the employed CTM in a charged state is increased at the light-application steps, the decrease of chargeability and the increase of residual potential can be prevented, thereby improving the durability of the organic photoconductor of a function-separating type. It is preferable that the rays of light to be described later be applied to the surface of the photoconductor in the stop of exposing the photoconductive layer to light images to form latent electrostatic images thereon and/or the step of quenching residual charges from the surface of the photoconductive layer.

Figure 2:
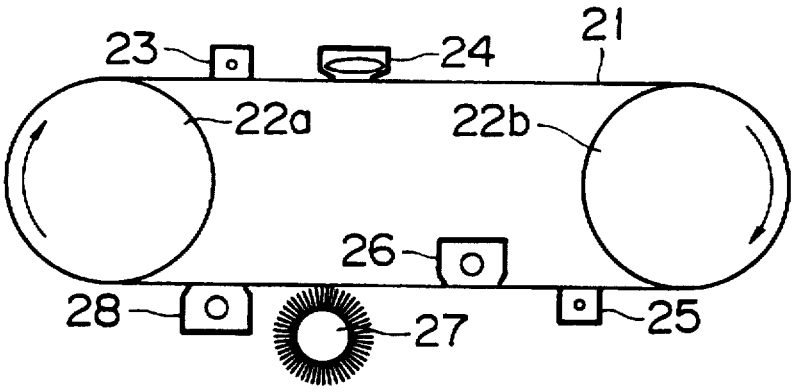
FIG. 2 is a schematic diagram which shows another example of the electrophotographic process and apparatus according to the present invention.

FIG. 2 is a schematic diagram which shows another example of the electrophotographic process and apparatus according to the present invention.

In FIG. 2, a photoconductor belt 21 is driven in rotation by driving rollers 22*a* and 22*b*. The photoconductor belt 21 is repeatedly subjected to a series of electrophotographic process using units situated along the photoconductor belt 21. Namely, the surface of the photoconductor belt 21 is charged to a predetermined surface potential using an electrical charger 23, the charged photoconductor belt 21 is exposed to light images to form latent electrostatic images by the image recording light exposure unit 24, the development of the latent electrostatic images is carried out at a developing unit (not shown), toner images are transferred to an image transfer sheet using a transfer charger 25, the photoconductor belt 21 free from toner images is exposed to light using a pre-cleaning light exposure unit 26, the residual toner particles are removed from the photoconductor belt 21 by a cleaning brush 27, and the residual charges are removed from the surface of the photoconductor belt 21 using a quenching light exposure unit 28.

In the electrophotographic apparatus of FIG. 2, the light is applied to the side of an electroconductive support of the photoconductor belt 21 at the pre-cleaning light exposure unit 26 since the electroconductive support permits the light to pass therethrough. As a matter of course, the light may be applied to the photoconductive layer side of the photoconductor belt 21 using the pre-cleaning light exposure unit 26. Similarly, the light may be applied to the electroconductive support side of the photoconductor belt 21 using the image recording light exposure unit 24 and the quenching light exposure unit 28.

In the course of the electrophotographic process of the present invention, a specific kind of light for use in the present invention, that is, type 1, type 2 and type 3 to be described later in detail, is applied to the surface of the photoconductor in at least one light-application step. For instance, in the electrophotographic apparatus of FIG. 2, the above-mentioned specific rays of light may be applied to the photoconductor belt 21 in the image recording light exposure unit 24, the pre-cleaning light exposure unit 26, and the quenching light exposure unit 28. In addition to the above, there may be provided a pre-transfer light exposure unit, and a pre-image recording light exposure unit. The specific rays of light selected from type 1, type 2 and type 3 are applied to the surface of the photoconductor in the course of at least one light-application step, preferably the step of exposing the photoconductor to light images to form latent electrostatic images thereon, or the step of quenching the residual charges from the surface of the photoconductor.

Each of the above-mentioned units for operating the electrophotographic process may be built, for example, in a copying machine, facsimile apparatus, and a printer. Alternatively, a process cartridge on which a photoconductor, charging means, light exposure means, developing means, transfer means, cleaning means and quenching means are mounted may be incorporated into the above-mentioned machine.

Figure 3:
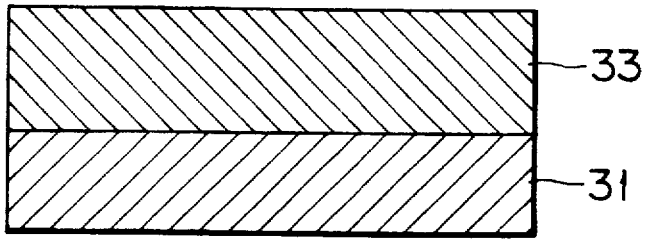
FIG. 3 is a schematic cross-sectional view of an example of an organic electrophotographic photoconductor for use in the present invention.
Figure 4:
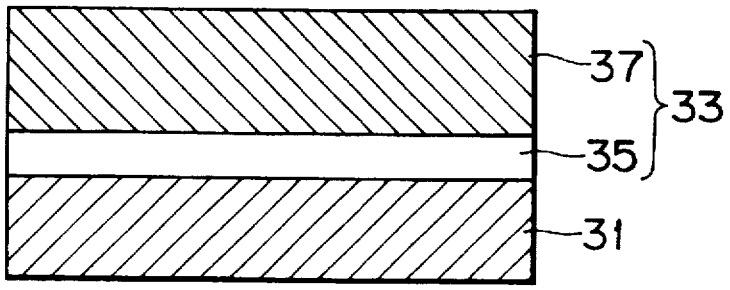
FIG. 4 is a schematic cross-sectional view of another example of an organic electrophotographic photoconductor for use in the present invention.
Figure 5:
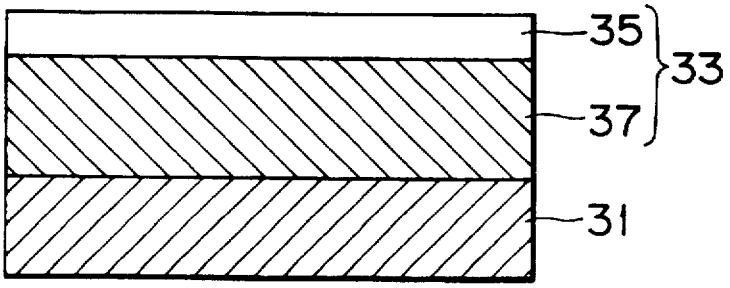
FIG. 5 is a schematic cross-sectional view of a further example of an organic electrophotographic photoconductor for use in the present invention.

FIGS. 3 to 5 are schematic cross-sectional views which show examples of the electrophotographic photoconductor for use in the present invention.

An electrophotographic photoconductor shown in FIG. 1 comprises an electroconductive support 31, and a single-layered photoconductive layer 33 formed thereon, comprising a charge generation material and a charge transport material.

As illustrated in FIG. 4, an electrophotographic photoconductor comprises an electroconductive support 31, and a charge generation layer 35 comprising as the main component a charge generation material and a charge transport layer 37 comprising as the main component a charge transport material which are successively overlaid on the electroconductive support 31. In an electrophotographic photoconductor shown in FIG. 5, the overlaying order of the charge generation layer 35 and the charge transport layer 37 is reversed.

To prepare the electroconductive support 31, an electroconductive material with a volume resistivity of $10^{10}$ Ωcm or less, for example, metals such as aluminum, nickel, chromium, nichrome, copper, silver, gold and platinum, and metallic oxides such as tin oxide and indium oxide is deposited or coated on a plastic film or cylinder or a sheet of paper by vacuum deposition or sputtering. Furthermore, a plate made of aluminum, aluminum alloy, nickel or stainless steel can be used for the electroconductive support 31. In this case, the above-mentioned plate is formed into a tube, and the thus formed tube is surface-treated by cutting, superfinishing and abrasive finishing to obtain an electroconductive support for the photoconductor.

The photoconductive layer 33 may be of a single-layered type or a laminated type in the present invention. The photoconductive layer 33 comprising a charge generation layer 35 and a charge transport layer 37 will now be explained in detail.

The charge generation layer 35 comprises as the main component the charge generation material, as previously mentioned.

Specific examples of the charge generation material include organic materials such as monoazo pigment, disazo pigment, trisazo pigment, perylene pigment, perinone pigment, quinacridone pigment, quinone condensation polycyclic compound, squaraines, phthalocyanine pigment, and azulenium salt dye; and inorganic materials such as selenium, selenium-tellurium, selenium-arsenic compound, and a-silicon (amorphous silicon).

Those charge generation materials are used alone or in combination.

The charge generation layer 35 may further comprise a binder retain.

Examples of such a binder rosin for use in the charge generation layer 35 are polyamide, polyurethane, polyester, epoxy resin, polyketone, polycarbonate, silicone resin, acrylic resin, polyvinyl butyral, polyvinyl formal, polyvinyl ketone, polystyrene and polyacrylamide.

To prepare the charge generation layer 35, a coating liquid for the charge generation layer may be prepared by dispersing the charge generation material in an appropriate solvent such as tetrahydrofuran, cyclohexanone, dioxane, 2-butanone or dichloroethane together with the binder resin using a ball mill, attritor, or sand mill.

It is preferable that the thickness of the charge generation layer 35 be in the range of 0.01 to 5 μm, more preferably in the range of 0.1 to 2 μm.

The charge transport layer 37 comprises the charge transport material, with a binder resin being optionally added thereto. The charge transport material is dissolved or dispersed in an appropriate solvent, optionally in combination with the binder resin, to prepare a coating liquid for the charge transport layer. The thus prepared coating liquid is coated and dried, so that a charge transport layer is provided. When necessary, the coating liquid for the charge transport layer may comprise a plasticizer and a leveling agent.

The charge transport material for use in the present invention includes a positive-hole transport material and an electron-transport material.

Examples of the electron-transport material include conventional electron acceptors such as chloroanil, bromoanil, tetracyanoethylene, tetracyanoquinodimethane, 2,4,7-trinitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and 3,5-dimethyl-3',5'-ditertiary butyl-4,4'-diphenoquinone.

Examples of the positive-hole transport material are oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, and butadiene derivatives.

Those charge transport materials may be used alone or in combination.

Examples of the binder resin for use in the charge transport layer 37 are thermoplastic resins and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, acrylic resin, silicone resin, epoxy resin, melamine resin, urethane resin, phenolic resin and alkyd resin.

Examples of the solvent used in the preparation of the charge transport layer coating liquid are tetrahydrofuran, dioxane, toluene, 2-butanone, monochlorobenzene, dichloroethane and methylene chloride.

Any plasticizer used for general resins, such as dibutyl phthalate or dioctyl phthalate may be added to the charge transport layer coating liquid as it is.

As the leveling agent for use in the charge transport layer coating liquid, there can be employed silicone oils such as dimethyl silicone oil and methylphenyl silicone oil, and polymers and oligomers having a perfluoroalkyl group on the side chain thereof.

It is preferable that the thickness of the charge transport layer 37 be in the range of 5 to 100 μm.

In the case of the single-layered photoconductive layer 33 as shown in FIG. 3, the function-separating photoconductive layer can be obtained because the above-mentioned charge generation material and charge transport material are contained therein. To provide the single-layered photoconductive layer 33 on the electroconductive support 31, a coating liquid prepared by dissolving or dispersing the charge generation material and the charge transport material in an appropriate solvent, optionally in combination with the binder resin may be coated on the electroconductive support 31 and dried. When necessary, the coating liquid for the photoconductive layer 33 may comprise a plasticizer and a leveling agent.

In addition, there can be employed a single-layered photoconductive layer 33 which comprises a eutectic crystal complex of pyrylium dye and bisphenol A polycarbonate, and a positive-hole transport material.

In the electrophotographic photoconductor for use in the present invention, an undercoat layer may be provided between the electroconductive support 31 and the photoconductive layer 33 by the conventional method. It is preferable that the thickness of the undercoat layer be 5 μm or less. Further, in order to protect the photoconductive layer 33, a protective layer may be provided on the photoconductive layer 33 by the conventional method. The proper thickness of the protective layer is in the range of about 0.5 to 10 μm.

The present invention will be explained in detail by referring to the relationship between the rays of light applied to the surface of the photoconductor at the light-application step and the absorption light of a charge transport material for use in the photoconductor when charged.

In the present invention, the light applied to the photoconductive layer of the photoconductor for the formation of latent electrostatic images thereon is basically required to contain therein the light components in such a wavelength range that can be absorbed by the charge generation material in the photoconductive layer. Otherwise, no charge carriers will be formed in the photoconductive layer and therefore no photoconduction will be carried out in the photoconductive layer.

Conventional research and development activities concerning the photoconduction in this field have been mainly directed to how the rays of light in such wavelength that can be absorbed by the charge generation material are efficiently applied to the photoconductive layer.

However, when the charge transport material is charged during the photoconduction in the photoconductive layer, in many cases, the charged charge transport material absorbs the rays of light with the wavelengths in the visible range through the near infrared range, so that there may be a case where the wavelength of the absorption light of the charge transport material partly overlaps the wavelength of the absorption light of the charge generation material. Therefore practically it is almost impossible to have only the charge generation material absorb the light, without having the charge transport material in the charged state absorb any light.

Under such circumstances, the present invention provides a light-application method by which the quantity of light that is absorbed by the charge transport material in the charged state is significantly reduced or minimized. As a matter of course, it will be the best to apply the light to the photoconductive layer in the wavelength range where there is no overlapping of the above-mentioned light absorption.

Figure 6:
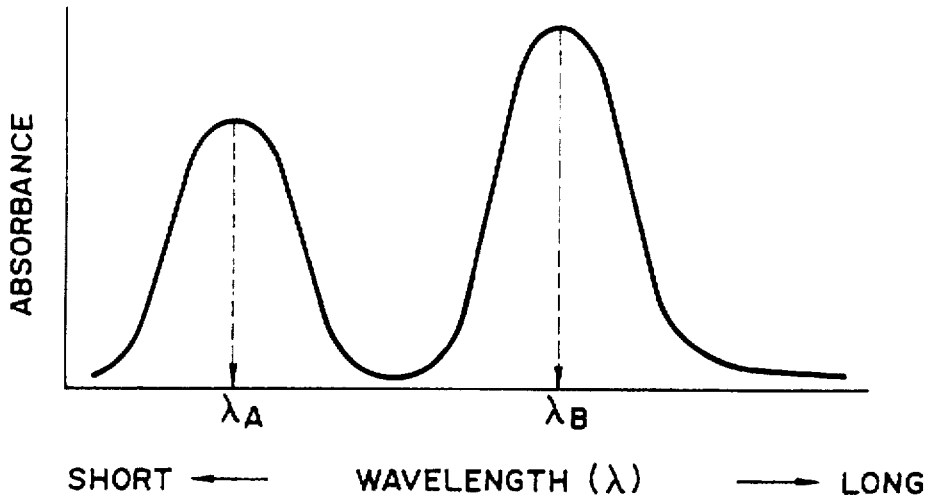
FIG. 6 is an absorption spectrum of a charge transport material with two absorption peaks in a charged state.

FIG. 6 is a schematic diagram of the absorption spectrum of the charge transport material in the charged state. The wavelengths of the two absorption peaks are $\lambda_A$ and $\lambda_B$ as shown in FIG. 6.

Figure 7:
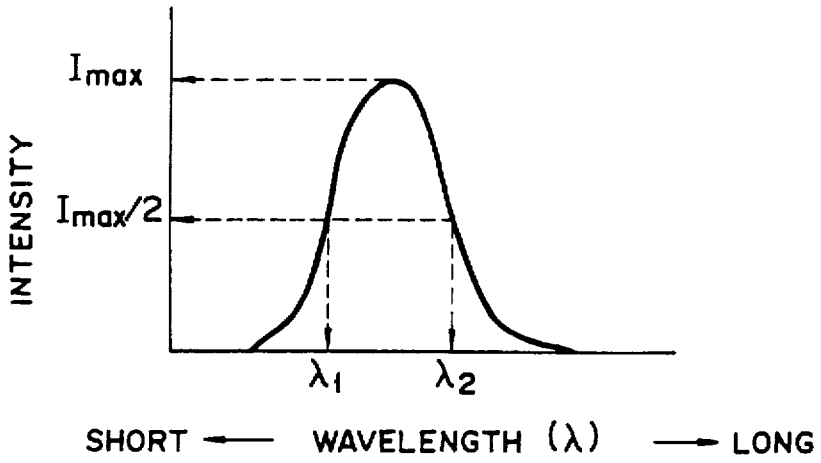
FIG. 7 is an emission spectrum of one kind of rays of light to be applied to the surface of an electrophotographic photoconductor for use in the present invention, which rays of light have a light emission peak.

FIG. 7 is a schematic diagram of a spectrum range of one type of rays of light to be applied to the photoconductive layer in the present invention, which may be referred to as type 1. This type of rays of light has a peak value $I_{max}$ in terms of the light intensity thereof, with a half value $\lambda_1$ of the peak value $I_{max}$ on a shorter wavelength side and a half value $\lambda_2$ of the peak value $I_{max}$ on a longer wavelength side.

In the electrophotographic process of the present invention, for example, when the light of the type 1 is applied to the photoconductive layer of the photoconductor comprising the charge transport material with the photoconduction properties as shown in FIG. 6 under any of the following conditions, good results can be obtained:

(1) $\lambda_2<\lambda_A$, (2) $\lambda_1>\lambda_A$ and $\lambda_2<\lambda_B$, and (3) $\lambda_1>\lambda_B$.

Generally, the above-mentioned rays of light, type 1, can be described as the rays of light having a light emission peak, with a half-width wavelength range thereof being free from the overlapping of a peak wavelength of an absorption light of the charge transport material in the charged state.

Figure 8:
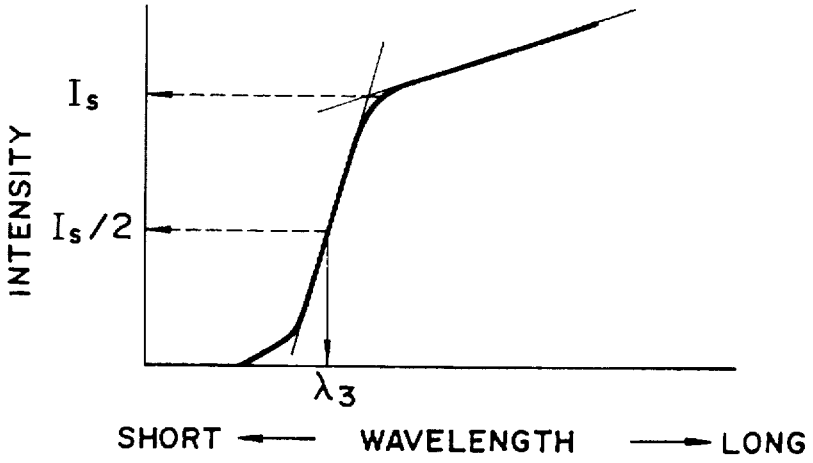
FIG. 8 is an emission spectrum of another kind of rays of light to be applied to the surface of an electrophotographic photoconductor for use in the present invention, which rays of light have a continuous spectrum, having a threshold wavelength value.

FIG. 8 is a schematic diagram of a spectrum range of another type of rays of light to be applied to the photoconductive layer, which may be referred to as type 2. This type of rays of light has a threshold wavelength value $I_B$ in terms of the light intensity thereof. The wavelength of a half value of the threshold wavelength value $I_B$ is $\lambda_3$.

In the electrophotographic process of the present invention, when light application is performed to the photoconductive layer of the photoconductor, comprising the charge transport material with the photoconduction properties as shown in FIG. 6, using the rays of light with a continuous spectrum, type 2, which is shown in FIG. 8, under the conditions of $\lambda_3>\lambda_B$, good results can be obtained.

Generally, the rays of light with a continuous spectrum, type 2, can be described as the rays of light having a threshold wavelength value, with the light emission components thereof being present on a longer wavelength side than the threshold wavelength value, and on a scale with the wavelength increasing in the right direction, a half value of the threshold wavelength value being on a longer wavelength side beyond the wavelength of a rightmost absorption peak of an absorption light of the charge transport material in the charged state.

Furthermore, the same rays of light with a continuous spectrum having a threshold wavelength value as mentioned above except that the light emission components thereof are present on a shorter wavelength side than the threshold wavelength value can also be employed in the electrophotographic process of the present invention. This type of rays of light may be referred to as type 3. When this type of rays of light, that is, type 3, is used in the above electrophotographic process, under the conditions of $\lambda_3<\lambda_A$ in a wavelength range free from the overlapping of the light absorption of the charge transport material in the neutral state and the light absorption of the charge transport material in the charged state, good results can be obtained.

Generally, the rays of light with a continuous spectrum, type 3, can be described as the rays of light having a threshold wavelength value, with the light emission components thereof being present on a shorter wavelength side than the threshold wavelength value, and on a scale with the wavelength decreasing in the left direction, a half value of the threshold wavelength value being on a shorter wavelength side beyond the wavelength of a leftmost absorption peak of an absorption light of the charge transport material in the charged state, in a wavelength range free from the overlapping of the light absorption of the charge transport material in the neutral state and the light absorption of the charge transport material in the charged state.

As mentioned previously, good results can be obtained when the light absorbed by the charge transport material in the charged state is minimized without reducing the quantity of the light applied to the charge generation material. This can be achieved very easily by using a light application method which uses coherent light, which has a light emission peak with a small half-width wavelength ($\lambda_2-\lambda_1$).

Figure 9:
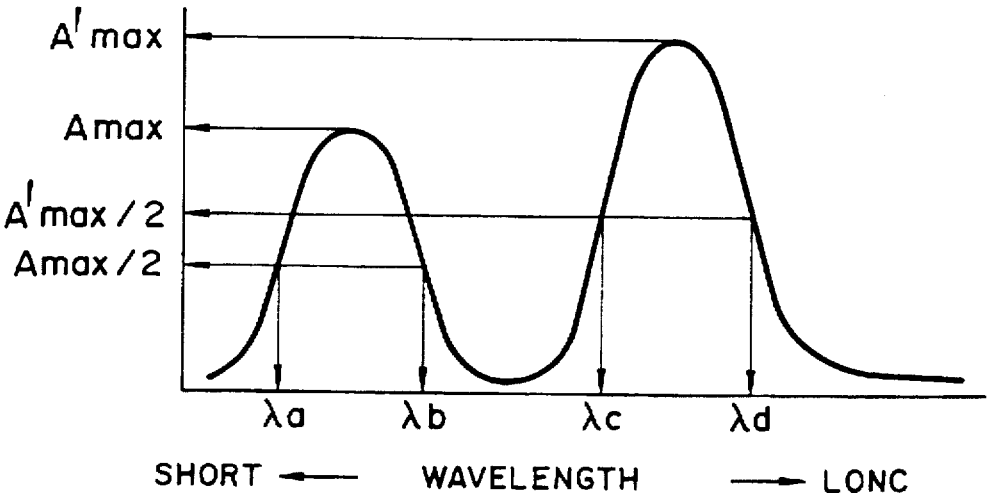
FIG. 9 is the same absorption spectrum of a charge transport material as that shown in FIG. 6, in explanation, of a half-width wavelength range of a peak wavelength of an absorption light of the charge transport material.

FIG. 9 is a schematic diagram of the absorption spectrum of the charge transport material in the charged state which is the same as shown in FIG. 6, provided that there are defined a half value $\lambda_a$ of an absorption peak on a shorter wavelength side of the charged charge transport material, and a half value $\lambda_b$ of the absorption peak on a longer wavelength side thereof, and a half value $\lambda_c$ of another absorption peak on a shorter wavelength side of the charged charge transport material, and a half value $\lambda_d$ of the absorption peak on a longer wavelength side thereof.

When the light of the type 1 as shown in FIG. 7 is applied, for example, to the photoconductive layer of the photoconductor, comprising the charge transport material with the photoconduction properties as shown in FIG. 9, under any of the following conditions, good results can be obtained:

(1) $\lambda_2<\lambda_a$, (2) $\lambda_1>\lambda_b$ and $\lambda_2<\lambda_c$, and (3) $\lambda_1>\lambda_d$.

In other words, in the above, there is employed the rays of light having a light emission peak, with a half-width wavelength range thereof being free from the overlapping of a half-width wavelength range of a peak wavelength of an absorption light of the charge transport material in the charged state, which rays of light may be referred to as type 1a.

In the electrophotographic process of the present invention, when light application is performed to the photoconductive layer of the photoconductor, comprising the charge transport material with the photoconduction properties as shown in FIG. 9, using the rays of light with a continuous spectrum, type 2, which is shown in FIG. 8, under the conditions of $\lambda_3>\lambda_d$, better results can be obtained.

In other words, in the above, there is employed the rays of light with a continuous spectrum having a threshold wavelength value, with the light emission components thereof being present on a longer wavelength side than the threshold wavelength value, and on a scale with the wavelength increasing in the right direction, a half value of the threshold wavelength value being on a longer wavelength side beyond a half-width wavelength range of a rightmost absorption peak of an absorption light of the charge transport material in the charged state, which rays of light may be referred to as type 2a.

Furthermore, the same rays of light with a continuous spectrum having a threshold wavelength value as mentioned above except that the light emission components thereof are present on a shorter wavelength side than the threshold wavelength value can also be employed in the electrophotographic process of the present invention. This type of rays of light is the same as the above-mentioned type 3. When this type of rays of light is used in the above electrophotographic process, under the conditions of $\lambda_3<\lambda_B$ in a wavelength range free, from the overlapping of the light absorption of the charge transport material in the neutral state and the light absorption of the charge transport material in the charged state, good results can be obtained.

In other words, in the above, there is employed the rays of light with a continuous spectrum having a threshold wavelength value, with the light emission components thereof being present on a shorter wavelength side than the threshold wavelength value, and on a scale with the wavelength decreasing in the left direction, a half value of the threshold wavelength value being on a shorter wavelength side beyond a half-width wavelength range of a leftmost absorption peak of an absorption light of the charge transport material in the charged state, in a wavelength range free from the overlapping of the light absorption of the charge transport material in the neutral state and the light absorption of the charge transport material in the charged state. This type of rays of light may be referred to as type 3a.

In any of the above-mentioned electrophotographic processes of the present invention, it is preferable that the rays of light be substantially free from the absorption light of the charge transport material in the charged state, where the term "substantially free from the absorption light" means that with respect to the light absorption of the charge transport material in the charged state, light application conditions are more restricted than those under the conditions shown in FIG. 7 and FIG. 8. For example, when a coherent light with a minimum absorption with a wavelength between $\lambda_b$ and $\lambda_d$, is employed for the application of light, better results can be obtained.

A method for measuring the light absorption spectrum of the charge transport material in the charged state will now be explained.

A photoconductive layer or a charge transport layer is held between two electrodes in such a manner that the upper and lower surfaces of the photoconductive layer or the charge transport layer are in contact with the inner surfaces of the two electrodes. A dark current or a photoelectric current is caused to flow through the photoconductive layer or the charge transport layer with the application of a voltage across the two electrodes, so that a light absorption spectrum or a light reflection spectrum of a light which is applied to the photoconductive layer or the charge transport layer is measured by a conventional spectrophotometer.

Alternatively, a simple method can be employed, in which the charge transport material is dissolved in an organic solvent, such as acetonitrile, methylene chloride, or dimethylformamide, together with an indifferent salt (or supporting electrolyte) such as tetraethylammonium perchlorate, or tetrabutylammonium perchlorate. This solution is then subjected to electrolysis, whereby the charge transport material is converted from a neutral state into a cationic radical state or into an anionic radical state. When the charge transport material is a positive hole transport material, the charge transport material is oxidized at the positive electrode and converted into the cationic radical state, while when the charge transport material is an electron transport material, the charge transport material is reduced at the negative electrode and converted into the anionic radical state.

In this method, the light absorption spectrum of the charge transport material in the cationic radical state or in the anionic radical state in the solution can be measured in the state of the above-mentioned solution by the conventional spectrophotometer.

Other features of this invention will become apparent in the course of the following description of exemplary embodiments, which are given for illustration of the invention and are not intended to be limiting thereof.

EXAMPLE 1

[Preparation of Electrophotographic Photoconductor]

A coating liquid for an undercoat layer was coated on an aluminum cylindrical drum serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 1 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Alcohol-soluble nylon | 5 |
| Methanol | 50 |
| Isopropanol | 20 |

(Formulation for charge generation layer coating liquid)

| | Parts by Weight |
|---|---|
| Charge generation material with the following formula: [Chemical Formula 1] | 5 |
| Polyvinyl butyral | 3 |
| Tetrahydrofuran | 200 |
| 4-methyl-2-pentanone | 90 |

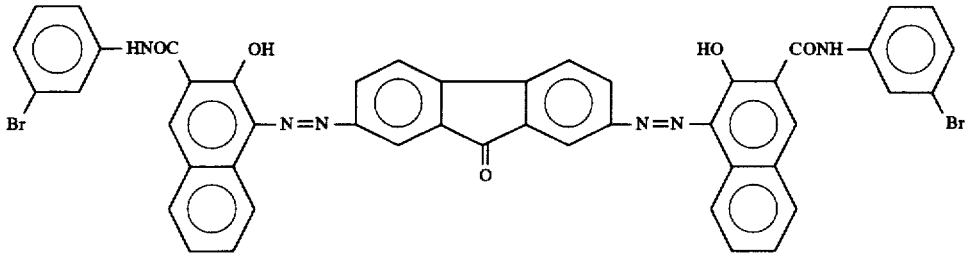

(Formulation for charge transport layer coating liquid)

| | Parts by Weight |
|---|---|
| Charge transport material with the following formula: [Chemical Formula 2] | 8 |
| Polycarbonate | 10 |
| Methylene chloride | 80 |

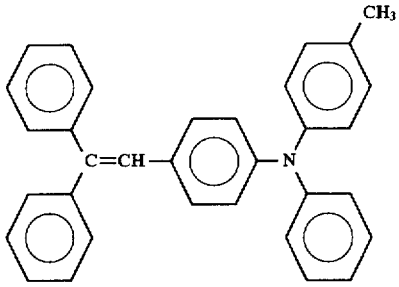

The absorption spectrum of the charge generation material and that of the charge transport material in a charged state were measured by the previously mentioned method. As a result, the charge generation material exhibited its absorption in the wavelength range of 400 to 680 nm. With the absorption spectrum of the charge generation material taken into consideration, the light to be applied, to the surface of the photoconductor to form latent electrostatic images thereon was required to have a wavelength range of 400 to 680 nm at least.

Figure 10:
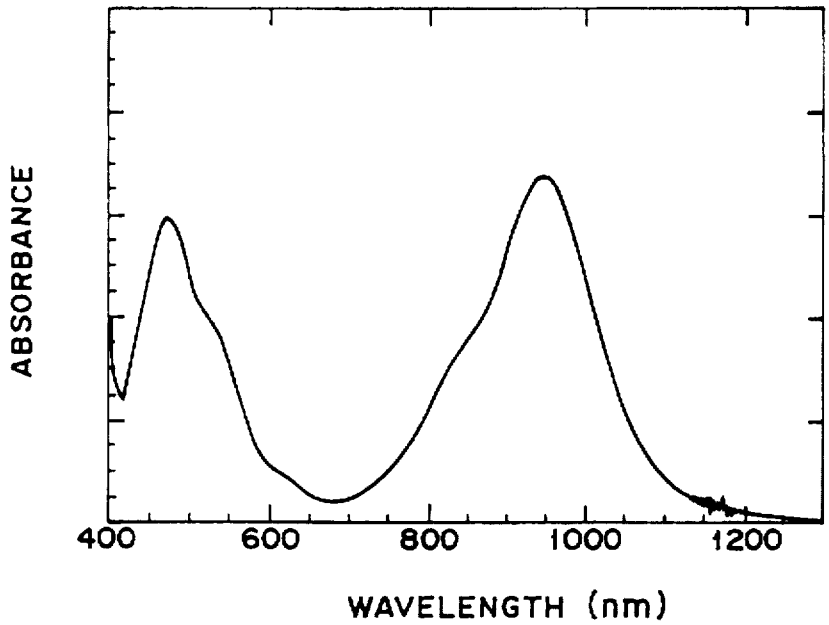
FIG. 10 is an absorption spectrum of a charge transport material in a charged state employed in Examples 1 through 13.

The absorption spectrum of the charge transport material in a charged state (in a cation radical state) is shown in FIG. 10. In FIG. 10, the wavelengths of two peaks, that is, $\lambda_A$ and $\lambda_B$ are respectively 474 nm and 952 nm. Further, the half-width wavelength values of the peak wavelength $\lambda_A$, that is, $\lambda_a$ and $\lambda_b$ are 425 nm and 554 nm; and the half-width wavelength values of the peak wavelength $\lambda_B$, that is, $\lambda_c$ and $\lambda_d$ are 840 nm and 1025 nm.

An electrophotographic apparatus of the present invention as shown in FIG. 1 was manufactured using the electrophotographic photoconductor No. 1. In this case, a tungsten limp (white light) without any filter was used as the light source for the image recording light exposure unit 5. For the light source of the quenching light exposure unit 2, a tungsten lamp was equipped with filters so that the half-width wavelength values of an emission peak, that is, $\lambda_1$ and $\lambda_2$ as shown in FIG. 7, might be respectively controlled to 480 nm and 940 nm.

Further, a probe for an electrometer was inserted into a surface portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit 6 as the photoconductor was drive in rotation. The above-mentioned surface potentials were measured after making one copy and 10,000 copies.

The results are shown in Table 1.

EXAMPLES 2 TO 5 AND COMPARATIVE EXAMPLES 1 TO 4

The procedure for manufacture of the electrophotographic apparatus as in Example 1 was repeated except that the filters for the light source (tungsten lamp) used for the quenching light exposure unit 2 in Example 1 were changed so as to have the half-width wavelength values ($\lambda_1$ and $\lambda_2$) of the emission peak as shown in Table 1.

Using each electrophotographic apparatus, the surface potentials of a light-exposed portion and a non light-exposed portion of the photoconductor were measured in the same manner as in Example 1 after making one copy and 10,000 copies.

The results are shown in Table 1.

TABLE 1

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 1 | *1 | *1 | 480 | 940 | 26 | 725 | 79 | 535 |
| Ex. 2 | *1 | *1 | 550 | 940 | 25 | 721 | 69 | 567 |
| Ex. 3 | *1 | *1 | 480 | 830 | 27 | 723 | 64 | 579 |
| Ex. 4 | *1 | *1 | 550 | 830 | 25 | 726 | 48 | 621 |
| Ex. 5 | *1 | *1 | 580 | 830 | 24 | 715 | 40 | 646 |
| Comp. Ex. 1 | *1 | *1 | *1 | *1 | 27 | 728 | 158 | 368 |
| Comp. Ex. 2 | *1 | *1 | 400 | 830 | 26 | 724 | 144 | 412 |
| Comp. Ex. 3 | *1 | *1 | 550 | *2 | 24 | 724 | 151 | 404 |
| Comp. Ex. 4 | *1 | *1 | 450 | 1000 | 25 | 722 | 162 | 380 |

*1 Tungsten light without any filter.
*2 Tungsten light without a filter for cutting longer wavelengths.

EXAMPLES 6 TO 11

The procedure for manufacture of the electrophotographic apparatus as in Example 4 was repeated except that the light source (tungsten lamp) used for the image recording light exposure unit 5 was equipped with filters so as to have the half-width wavelength values of an emission peak, that is, $\lambda_1$ and $\lambda_2$ shown in Table 2.

Using each electrophotographic apparatus, the surface potentials of a light-exposed portion and a non light-exposed portion of the photoconductor were measured in the same manner as in Example 1 after making one copy and 10,000 copies.

The results are shown in Table 2.

TABLE 2

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 6 | 450 | *2 | 550 | 830 | 26 | 720 | 48 | 619 |
| Ex. 7 | 480 | *2 | 550 | 830 | 26 | 716 | 44 | 628 |
| Ex. 8 | 550 | *2 | 550 | 830 | 25 | 723 | 39 | 643 |
| Ex. 9 | 450 | 700 | 550 | 830 | 27 | 727 | 40 | 640 |
| Ex. 10 | 480 | 700 | 550 | 830 | 24 | 719 | 34 | 665 |
| Ex. 11 | 550 | 700 | 550 | 830 | 25 | 719 | 32 | 672 |

*2 Tungsten light without a filter for cutting longer wavelengths.

EXAMPLE 12

The procedure for manufacture of the electrophotographic apparatus as in Example 10 was repeated except that the tungsten lamp equipped with the filters as the light source for the quenching light exposure unit 2 in Example 10 was replaced by a light emitting diode (LED) exhibiting a peak with a wavelength of 630 nm.

Using the above electrophotographic apparatus, the surface potentials of a light-exposed portion and a non light-exposed portion of the photoconductor were measured in the same manner as in Example 1 after making one copy and 10,000 copies.

The results are shown in Table 3.

EXAMPLE 13

The procedure for manufacture of the electrophotographic apparatus as in Example 10 was repeated except that the tungsten lamp equipped with the filters as the light source for the image recording light exposure unit 5 in Example 10 was replaced by a helium-neon (He-Ne) laser with a wavelength of 632.8 nm and a polygon mirror.

Using the above electrophotographic apparatus, the surface potentials of a light-exposed portion and a non light-exposed portion of the photoconductor were measured in the same manner as in Example 1 after making one copy and 10,000 copies.

The results are shown in Table 3.

TABLE 3

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 12 | 480 | 700 | 610(*3) | 645(*3) | 26 | 721 | 29 | 690 |
| Ex. 13 | *4 | *4 | 550 | 830 | 25 | 723 | 27 | 702 |

*3 Light emitting diode (LED) exhibiting an emission peak with a wavelength of 630 nm was employed.
*4 He-Ne laser with a wavelength of 632.8 nm was employed.

EXAMPLE 14

[Preparation of Electrophotographic Photoconductor]

A coating liquid for an undercoat layer was coated on an electroformed nickel belt serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 2 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Titanium dioxide powder | 5 |
| Alcohol-soluble nylon | 4 |
| Methanol | 50 |
| Isopropanol | 20 |

(Formulation for charge generation layer coating liquid)

| | Parts by Weight |
|---|---|
| Oxytitanium phthalocyanine | 4 |
| Polyvinyl butyral | 1 |
| Cyclohexanone | 150 |
| Tetrahydrofuran | 100 |

(Formulation :for charge transport layer coating liquid)

| | Parts by Weight |
|---|---|
| Charge transport material with the following formula: [Chemical Formula 3] | 9 |
| Polycarbonate | 10 |
| Tetrahydrofuran | 80 |

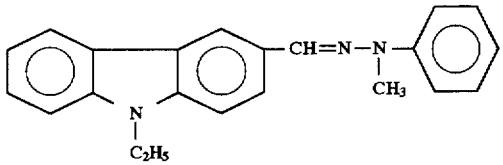

The absorption spectrum of the charge generation material and that of the charge transport material in a charged state were measured by the previously mentioned method. As a result, the charge generation material exhibited its absorption in the wavelength range of 540 to 880 nm. With the absorption spectrum of the charge generation material taken into consideration, the light to be applied to the surface of the photoconductor to form latent electrostatic images thereon was required to have a wavelength range of 540 to 880 nm at least.

Figure 11:
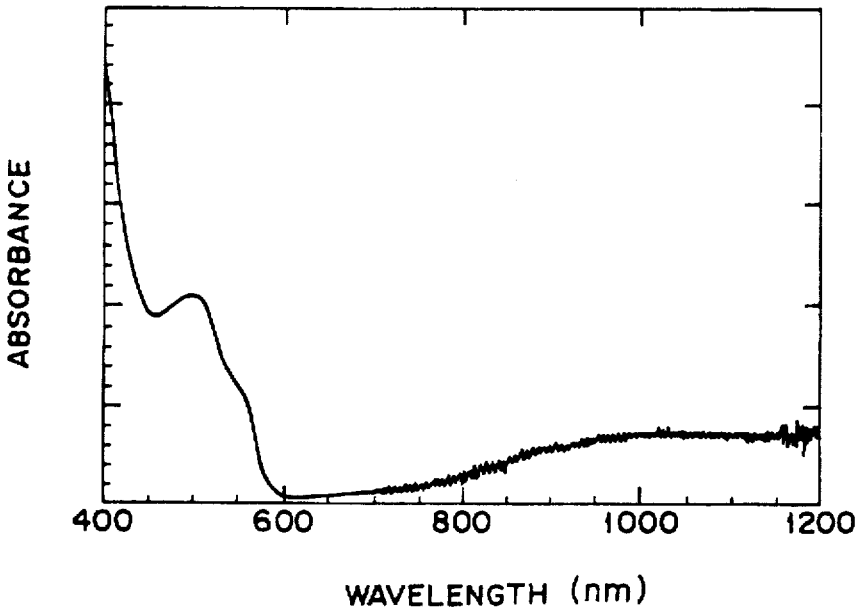
FIG. 11 is an absorption spectrum of a charge transport material in a charged state employed in Examples 14 through 20.

The absorption spectrum of the charge transport material in a charged state (in a cation radical state) is shown in FIG. 11. In FIG. 11, the wavelengths of two peaks, that is, $\lambda_A$ and $\lambda_B$ are respectively 497 nm and 1022 nm Further, the half-width wavelength value of the peak wavelength $\lambda_A$, that is, $\lambda_b$ is 565 nm; and the half-width wavelength value of the peak wavelength $\lambda_B$, that is, $\lambda_c$ is 826 nm. In this case, it was impossible to measure the wavelength values of $\lambda_a$ and $\lambda_d$.

An electrophotographic apparatus of the present invention as shown in FIG. 2 was manufactured using the electrophotographic photoconductor No. 2. In this case, a semiconductor laser beam with a wavelength of 780 nm serving as the light source and a polygon mirror were used for the image recording light exposure unit 24. For the light source of the quenching light exposure unit 28, a tungsten lamp was equipped with filters so that the half-width wavelength values of an emission peak, that is, $\lambda_1$ and $\lambda_2$ as shown in FIG. 7, might be respectively controlled to 510 nm and 810 nm.

In the thus prepared electrophotographic apparatus, the pre-cleaning light exposure unit 26 was not provided.

Further, a probe for an electrometer was inserted into a surfaces portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit as the photoconductor was drive in rotation. The above-mentioned surface potentials were measured after making one copy and 10,000 copies.

The results are shown in Table 4.

EXAMPLES 15 TO 18 AND COMPARATIVE EXAMPLES 5 TO 8

The procedure for manufacture of the electrophotographic apparatus as in Example 14 was repeated except that the filters for the light source (tungsten lamp) used for the quenching light exposure unit 28 in Example 14 were changed so as to have the half-width wavelength values ($\lambda_1$ and $\lambda_2$) of the emission peak as shown in Table 3.

Using each electrophotographic apparatus, the face potentials of a light-exposed portion and a non light-exposed portion of the photoconductor were measured in the same manner as in Example 14 after making one copy and 10,000 copies.

The results are shown in Table 4.

TABLE 4

| | Light for Image Recording Light Exposure | | Light for Quenching Light Exposure | | Surface Potential of Photoconductor (V): After making of one copy | | Surface Potential of Photoconductor (V): After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 14 | *5 | *5 | 550 | 810 | 23 | 642 | 69 | 493 |
| Ex. 15 | *5 | *5 | 530 | 810 | 24 | 640 | 62 | 520 |
| Ex. 16 | *5 | *5 | 570 | 810 | 22 | 642 | 45 | 572 |
| Ex. 17 | *5 | *5 | 530 | 700 | 24 | 639 | 48 | 566 |

TABLE 4-continued

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 18 | *5 | *5 | 570 | 950 | 25 | 641 | 74 | 484 |
| Comp. Ex. 5 | *5 | *5 | *1 | *1 | 24 | 638 | 148 | 319 |
| Comp. Ex. 6 | *5 | *5 | 400 | 700 | 21 | 640 | 121 | 360 |
| Comp. Ex. 7 | *5 | *5 | 570 | *2 | 23 | 637 | 139 | 336 |
| Comp. Ex. 8 | *5 | *5 | 480 | 950 | 22 | 642 | 132 | 348 |

*1 Tungsten light without any filter.
*2 Tungsten light without a filter for cutting longer wavelengths.
*5 Semiconductor laser with a wavelength of 780 nm was employed.

EXAMPLE 19

The procedure for manufacture of the electrophotographic apparatus as in Example 14 was repeated except that the tungsten lamp equipped with the filters as the light source for the quenching light exposure unit 28 in Example 14 was replaced by a light emitting diode (LED) exhibiting a peak with a wavelength of 840 nm.

Using the above electrophotographic apparatus, the surface potentials of a light-exposed portion and a non light-exposed portion of the photoconductor were measured in the same manner as in Example 14 after making one copy and 10,000 copies.

The results are shown in Table 5.

EXAMPLE 20

The procedure for manufacture of the electrophotographic apparatus as in Example 14 was repeated except that the tungsten lamp equipped with the filters as the light source for the quenching light exposure unit 28 in Example 14 was replaced by a light emitting diode (LED) exhibiting a peak with a wavelength of 630 nm.

Using the above electrophotographic apparatus, the surface potentials of a light-exposed portion and a non light-exposed portion of the photoconductor were measured in the same manner as in Example 14 after making one copy and 10,000 copies.

The results are shown in Table 5.

TABLE 5

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 19 | *5 | *5 | 820(*6) | 860(*6) | 25 | 640 | 42 | 687 |
| Ex. 20 | *5 | *5 | 610(*3) | 645(*3) | 24 | 642 | 31 | 620 |

*3 Light emitting diode (LED) exhibiting an emission peak with a wavelength of 630 nm was employed.
*5 Semiconductor laser with a wavelength of 780 nm was employed.
*6 Light emitting diode (LED) exhibiting an emission peak with a wavelength of 840 nm was employed.

EXAMPLE 21

[Preparation of Electrophotographic Photoconductor]

A coating liquid for an undercoat layer was coated on an aluminum cylindrical drum serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 3 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Alcohol-soluble nylon | 5 |
| Methanol | 50 |
| Isopropanol | 20 |

(Formulation for charge generation layer coating liquid)

| | Parts by Weight |
|---|---|
| Charge generation material with the following formula: [Chemical Formula 4] | 5 |

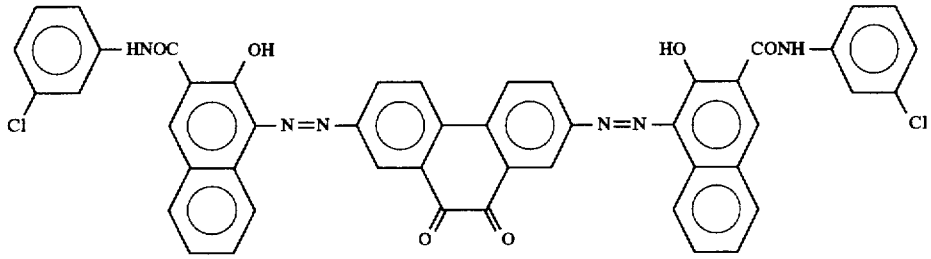

| | |
|---|---|
| Polyvinyl butyral | 2 |
| Tetrahydrofuran | 200 |
| 4-methyl-2-pentanone | 90 |

(Formulation for charge transport layer coating liquid)

| | Parts by Weight |
|---|---|
| Charge transport material with the following formula: [Chemical Formula 5] | 8 |

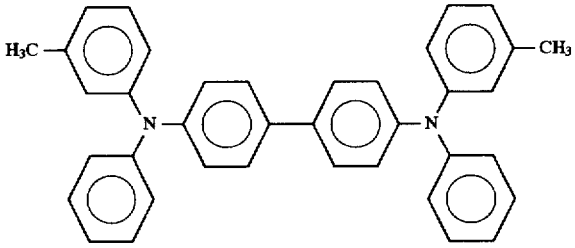

| | |
|---|---|
| Polycarbonate | 10 |
| Methylene chloride | 80 |

The absorption spectrum of the charge generation material and that of the charge transport material in a charged state were measured by the previously mentioned method. As a result, the charge generation material exhibited its absorption in the wavelength range of 400 to 780 nm. With the absorption spectrum of the charge generation material taken into consideration, the light to be applied to the surface of the photoconductor to form latent electrostatic images thereon was required to have a wavelength range of 400 to 780 nm at least.

Figure 12:
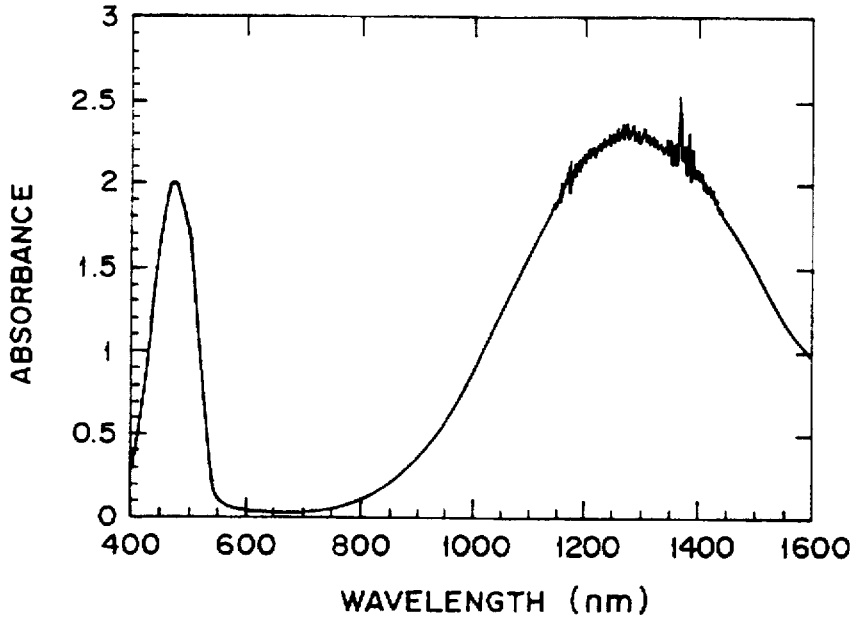
FIG. 12 is an absorption spectrum of a charge transport material in a charged state employed in Examples 21 through 25.

The absorption spectrum of the charge transport material in a charged state (in a cation radical state) is shown in FIG. 12. In FIG. 12, the wavelengths of two peaks, that is, $\lambda_A$ and $\lambda_B$ are respectively 480 nm and 1264 nm. Further, the half-width wavelength values of the peak wavelength $\lambda_A$, that is, $\lambda_a$ and $\lambda_b$ are 432 nm and 522 nm; and the half-width wavelength values of the peak wavelength $\lambda_B$, that is, $\lambda_c$ and $\lambda_d$ are 1039 nm and 1560 nm.

An electrophotographic apparatus of the present invention as shown in FIG. 1 was manufactured using the electrophotographic photoconductor No. 3. For the light source for the image recording light exposure unit 5, a tungsten lamp was equipped with a dichroic filter so that the half-width wavelength values of an emission peak, that is, $\lambda_1$ and $\lambda_2$ as shown in FIG. 7, might be respectively controlled to 460 nm and 640 nm. For the light source of the quenching light exposure unit 2, a tungsten lamp was equipped with filters so that the half-width wavelength values of an emission peak, that is, $\lambda_1$ and $\lambda_2$ as shown in FIG. 7, might be respectively controlled to 520 nm and 1100 nm.

Further, a probe for an electrometer was inserted into a surface portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit 6 as the photoconductor was drive in rotation. The above-mentioned surface potentials were measured after making one copy and 10,000 copies.

The results are shown in Table 6.

EXAMPLES 22 TO 25 AND COMPARATIVE EXAMPLES 9 TO 12

The procedure for manufacture of the electrophotographic apparatus as in Example 21 was repeated except that the filter for the light source (tungsten lamp) used for the quenching light exposure unit 2 in Example 21 were changed so as to have the half-width wavelength values ($\lambda_1$ and $\lambda_2$) of the emission peak as shown in Table 6.

Using each electrophotographic apparatus, the surface potentials of a light-exposed portion and a non light-exposed portion of the photoconductor were measured in the same manner as in Example 21 after making one copy and 10,000 copies.

The results are shown in Table 6.

TABLE 6

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 21 | 460 | 640 | 520 | 1100 | 22 | 720 | 75 | 532 |
| Ex. 22 | 460 | 640 | 540 | 1050 | 20 | 709 | 65 | 563 |
| Ex. 23 | 460 | 640 | 520 | 900 | 23 | 719 | 60 | 575 |
| Ex. 24 | 460 | 640 | 540 | 900 | 21 | 721 | 44 | 618 |
| Ex. 25 | 460 | 640 | 570 | 750 | 22 | 705 | 36 | 643 |
| Comp. Ex. 9 | 460 | 640 | *1 | *1 | 25 | 722 | 165 | 364 |
| Comp. Ex. 10 | 460 | 640 | 400 | 830 | 23 | 718 | 142 | 405 |
| Comp. Ex. 11 | 460 | 640 | 500 | *2 | 19 | 717 | 148 | 398 |
| Comp. Ex. 12 | 460 | 640 | 430 | *2 | 20 | 712 | 159 | 379 |

*1 Tungsten light without any filter.
*2 Tungsten light without a filter for cutting longer wavelengths.

EXAMPLE 26

[Preparation of Electrophotographic Photoconductor]

A coating liquid for an undercoat layer was coated on an electroformed nickel belt serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 4 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Titanium dioxide powder | 5 |
| Alcohol-soluble nylon | 4 |
| Methanol | 50 |
| Isopropanol | 20 |

(Formulation for charge generation layer coating liquid)

| | Parts by Weight |
|---|---|
| Charge generation material with the following formula: [Chemical Formula 6] | 4 |

-continued

| | Parts by Weight |
|---|---|
| 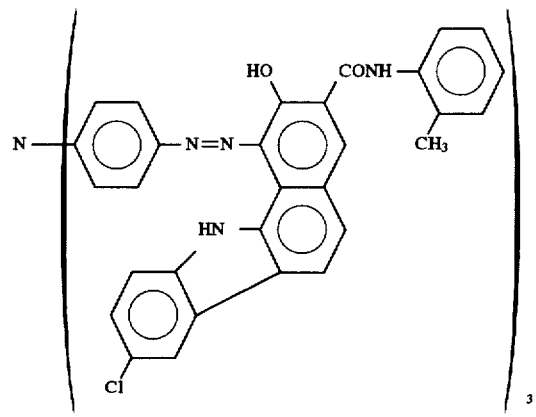 | 3 |
| Polyvinyl butyral | 2 |
| Cyclohexanone | 150 |
| Tetrahydrofuran | 100 |

(Formulation for charge transport layer coating liquid)

| | Parts by Weight |
|---|---|
| Charge transport material with the following formula: [Chemical Formula 7] 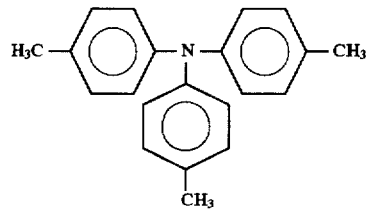 | 7 |

-continued

| | Parts by Weight |
|---|---|
| Polycarbonate | 10 |
| Tetrahydrofuran | 80 |

The absorption spectrum of the charge generation material and that of the charge transport material in a charged state were measured by the previously mentioned method. As a result, the charge generation material exhibited its absorption in the wavelength range of 400 to 820 nm. With the absorption spectrum of the charge generation material taken into consideration, the light to be applied to the surface of the photoconductor to form latent electrostatic images thereon was required to have a wavelength range of 400 to 820 nm at least.

Figure 13:
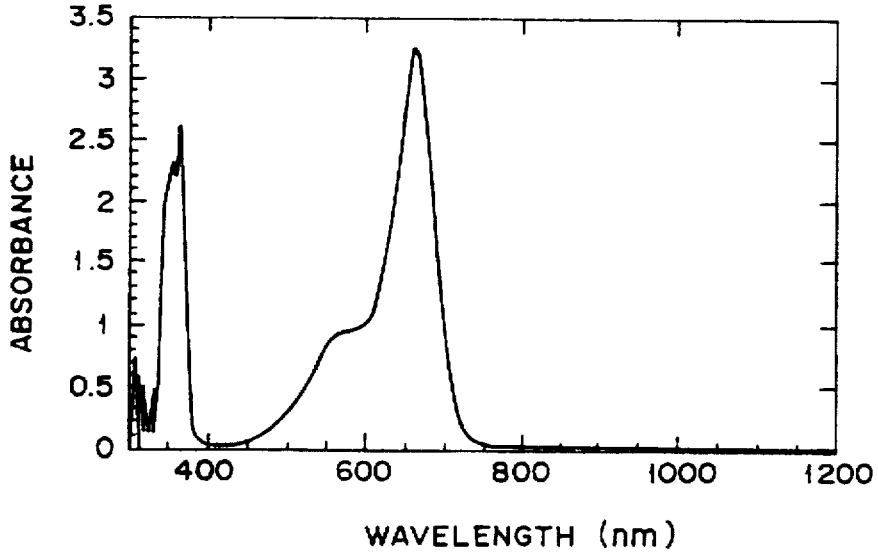
FIG. 13 is an absorption spectrum of a charge transport material in a charged state employed in Examples 26 through 30.

The absorption spectrum of the charge transport material in a charged state (in a cation radical state) is shown in FIG. 13. In FIG. 13, the wavelengths of two peaks, that is, $\lambda_A$ and $\lambda_B$ are respectively 367 nm and 668 nm. Further, one of the half-width wavelength values of the peak wavelength $\lambda_A$, that is, $\lambda_b$ in 374 nm; and the half-width wavelength values of the peak wavelength $\lambda_B$, that is, $\lambda_c$ and $\lambda_d$ are respectively 629 nm and 695 nm. In this case, it: was impossible to measure the wavelength value of $\lambda_a$.

An electrophotographic apparatus of the present invention as shown in FIG. 2 was manufactured using the electrophotographic photoconductor No. 4. In this case, a semiconductor laser beam with a wavelength of 780 nm serving as the light source and a polygon mirror were used for the image recording light exposure unit 24. For the light source of the quenching light exposure unit 28, a tungsten lamp was equipped with a filter for cutting specific shorter wavelengths so that the half value of the threshold wavelength value, that is, $\lambda_3$ as shown in FIG. 8, might be controlled to 700 nm.

In the thus prepared electrophotographic apparatus, the pre-cleaning light exposure unit 26 was not provided.

Further, a probe for an electrometer was inserted into a surface portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit as the photoconductor was drive in rotation. The above-mentioned surface potentials were measured after making one copy and 5,000 copies.

The results are shown in Table 7.

EXAMPLES 27 AND 28 AND COMPARATIVE EXAMPLES 13 TO 15

The procedure for manufacture of the electrophotographic apparatus as in Example 26 was repeated except that the filter for the light source (tungsten lamp) used for the quenching light exposure unit 28 in Example 26 was changed so as to have the half value of the threshold wavelength value ($\lambda_3$) as shown in Table 7.

Using each electrophotographic apparatus, the surface potentials of a light-exposed portion and a non light-exposed portion of the photoconductor were measured in the same manner as in Example 26 after making one copy and 5,000 copies.

The results are shown in Table 7.

TABLE 7

| | Light for Image Recording Light Exposure | | Light for Quenching Light Exposure | Surface Potential of Photoconductor (V) After making of one copy | | After making of 5,000 copies | |
|---|---|---|---|---|---|---|---|
| | $\lambda_1$(nm) | $\lambda_2$(nm) | $\lambda_3$(nm) | Light-exposed portion | Non-exposed portion | Light-exposed portion | Non-exposed portion |
| Ex. 26 | *5 | *5 | 700 | 25 | 648 | 48 | 580 |
| Ex. 27 | *5 | *5 | 750 | 26 | 643 | 64 | 525 |
| Ex. 28 | *5 | *5 | 680 | 24 | 645 | 70 | 501 |
| Comp. Ex. 13 | *5 | *5 | *1 | 27 | 640 | 151 | 320 |
| Comp. Ex. 14 | *5 | *5 | 660 | 28 | 639 | 128 | 348 |
| Comp. Ex. 15 | *5 | *5 | 600 | 26 | 637 | 139 | 337 |

*1 Tungsten light without any filter.
*5 Semiconductor laser with a wavelength of 780 nm was employed.

EXAMPLE 29

The procedure for manufacture of the electrophotographic apparatus as in Example 26 was repeated except that the tungsten lamp equipped with the filter as the light source for the quenching light exposure unit 28 in Example 26 was replaced by a light emitting diode (LED) exhibiting a peak with a wavelength of 810 nm.

Using the above electrophotographic apparatus, the surface potentials of a light-exposed portion and a non light-exposed portion of the photoconductor were measured in the same manner as in Example 26 after making one copy and 5,000 copies.

The results are shown in Table 8.

EXAMPLE 30

The procedure for manufacture of the electrophotographic apparatus as in Example 26 was repeated except that the tungsten lamp equipped with the filter as the light source for the quenching light exposure unit 28 in Example 26 was replaced by an argon (Ar) laser with a wavelength of 488 nm.

Using the above electrophotographic apparatus, the surface potentials of a light-exposed portion and a non light-exposed portion of the photoconductor were measured in the same manner as in Example 26 after making one copy and 5,000 copies.

The results are shown in Table 8.

COMPARATIVE EXAMPLE 16

The procedure for manufacture of the electrophotographic apparatus as in Example 26 was repeated except that the tungsten lamp equipped with the filter as the light source for the quenching light exposure unit 28 in Example 26 was replaced by a light emitting diode (LED) exhibiting a peak with a wavelength of 670 nm.

Using the above electrophotographic apparatus, the surface potentials of a light-exposed portion and a non light-exposed portion of the photoconductor were measured in the same manner as in Example 26 after making one copy and 5,000 copies.

The results are shown in Table 8.

TABLE 8

| | Light for Image Recording Light Exposure | | Light for Quenching Light Exposure | | Surface Potential of Photoconductor (V) After making of one copy | | After making of 5,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 29 | *5 | *5 | 790(*7) | 830(*7) | 24 | 645 | 38 | 622 |
| Ex. 30 | *5 | *5 | *8 | *8 | 25 | 637 | 45 | 586 |
| Comp. Ex. 16 | *5 | *5 | 650(*9) | 690(*9) | 27 | 640 | 140 | 353 |

*5 Semiconductor laser with a wavelength of 780 nm was employed.
*7 Light emitting diode (LED) exhibiting an emission peak with a wavelength of 810 nm was employed.
*8 Ar laser with a wavelength of 488 nm was employed.
*9 Light emitting diode (LED) exhibiting an emission peak with a wavelength of 670 nm was employed.

EXAMPLE 31

[Preparation of Electrophotographic Photoconductor]

A coating liquid for an undercoat layer was coated on an aluminum cylindrical drum serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 5 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Titanium dioxide powder | 5 |
| Alcohol-soluble nylon | 4 |
| Methanol | 50 |
| Isopropanol | 20 |

(Formulation for charge generation layer coating liquid)

| | Parts by Weight |
|---|---|
| Charge generation material with the following formula: [Chemical Formula 8] | 5 |

-continued

| | Parts by Weight |
|---|---|
| 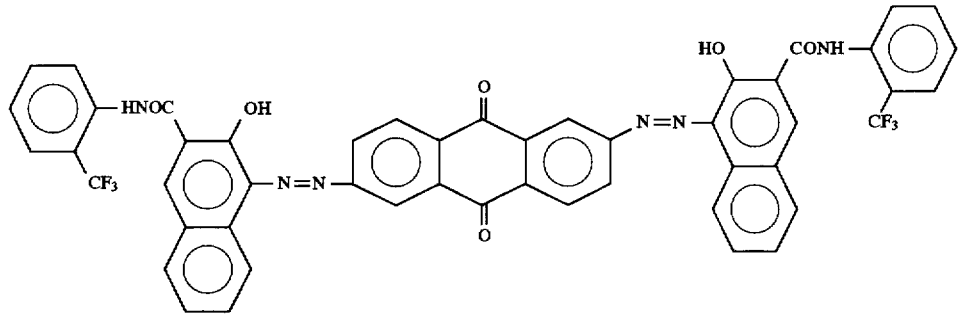 | |
| Polyvinyl butyral | 3 |
| Tetrahydrofuran | 200 |
| 4-methyl-2-pentanone | 90 |

(Formulation for charge transport layer coating liquid)

| | Parts by Weight |
|---|---|
| Charge transport material with the following formula: [Chemical Formula 9] | 8 |
| 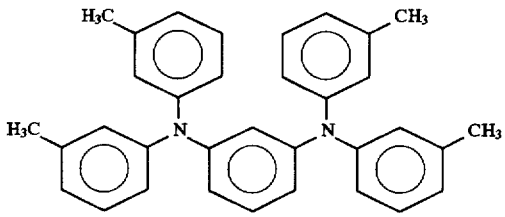 | |
| Polycarbonate | 10 |
| Methylene chloride | 80 |

The absorption spectrum of the charge generation material and that of the charge transport material in a charged state were measured by the previously mentioned method. As a result, the charge generation material exhibited its absorption in the wavelength range of 400 to 600 nm. With the absorption spectrum of the charge generation material taken into consideration, the light to be applied to the surface of the photoconductor to form latent electrostatic images thereon was required to have a wavelength range of 400 to 600 nm at least.

Figure 14:
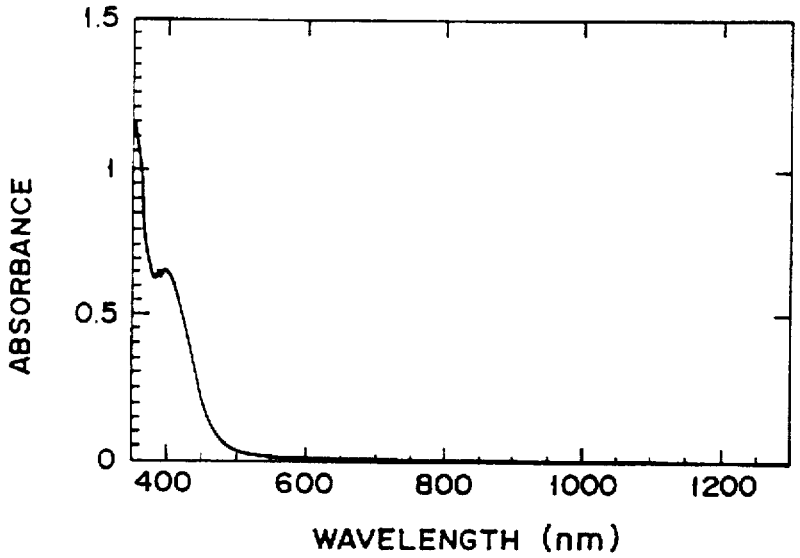
FIG. 14 is an absorption spectrum of a charge transport material in a charged state employed in Examples 31 through 34.

The absorption spectrum of the charge transport material in a charged state (in a cation radical state) is shown in FIG. 14. In FIG. 14, the wavelengths of two peaks, that is, $\lambda_A$ and $\lambda_B$ are respectively 358 nm and 398 nm. Further, the half-width wavelength value of the peak wavelength $\lambda_A$ in a longer wavelength region overlaps the absorption peak with the peak wavelength of $\lambda_B$. In this case, it was impossible to measure the wavelength values of $\lambda_a$, $\lambda_b$ and $\lambda_c$. The wavelength value of $\lambda_d$ is 439 nm.

An electrophotographic apparatus of the present invention as shown in FIG. 1 was manufactured using the electrophotographic photoconductor No. 5. In this case, a tungsten lamp (white light) was used as the light source for the image recording light exposure unit 5. For the light source of the quenching light exposure unit 2, a tungsten lamp was equipped with a filter for cutting specific shorter wavelengths so that the half value of the threshold wavelength value, that is, $\lambda_3$ as shown in FIG. 8, might be controlled to 410 nm.

Further, a probe for an electrometer was inserted into a surface portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit as the photoconductor was drive in rotation. The above-mentioned surface potentials were measured after making one copy and 5,000copies.

The results are shown in Table 9.

EXAMPLES 32 AND 33 AND COMPARATIVE EXAMPLE 17

The procedure for manufacture of the electrophotographic apparatus as in Example 31 was repeated except that the filter for the light source (tungsten lamp) used for the quenching light exposure unit 2 in Example 31 was changed so as to have the half value of the threshold wavelength value ($\lambda_3$) as shown in Table 9.

Using each electrophotographic apparatus, the surface potentials of a light-exposed portion and a non light-exposed portion of the photoconductor were measured in the same manner as in Example 31 after making one copy and 5,000 copies.

The results are shown in Table 9.

TABLE 9

| | Light for Image Recording Light Exposure | | Light for Quenching Light Exposure | Surface Potential of Photoconductor (V) After making of one copy | | After making of 5,000 copies | |
|---|---|---|---|---|---|---|---|
| | $\lambda_1$(nm) | $\lambda_2$(nm) | $\lambda_3$(nm) | Light-exposed portion | Non-exposed portion | Light-exposed portion | Non-exposed portion |
| Ex. 31 | *1 | *1 | 410 | 28 | 688 | 80 | 596 |
| Ex. 32 | *1 | *1 | 450 | 30 | 687 | 73 | 614 |
| Ex. 33 | *1 | *1 | 520 | 26 | 695 | 63 | 646 |
| Comp. Ex. 17 | *1 | *1 | *1 | 27 | 692 | 158 | 370 |

*1 Tungsten light without any filter.

EXAMPLE 34

The procedure for manufacture of the electrophotographic apparatus as in Example 31 was repeated except that the tungsten lamp equipped with the filter as the light source for the quenching light exposure unit 2 in Example 31 was replaced by an argon (Ar) laser with a wavelength of 514.5 nm.

Using the above electrophotographic apparatus, the surface potentials of a light-exposed portion and a non light-exposed portion of the photoconductor were measured in the same manner as in Example 31 after making one copy and 5,000 copies.

The results are shown in Table 10.

TABLE 10

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 34 | *1 | *1 | *10 | *10 | 25 | 700 | 65 | 650 |

*1 Tungsten light without any filter.
*10 Ar laser with a wavelength of 514.5 nm was employed.

EXAMPLE 35

[Preparation of Electrophotographic Photoconductor]

A coating liquid for an undercoat layer was coated on an electroformed nickel belt serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 6 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Titanium dioxide powder | 5 |
| Alcohol-soluble nylon | 4 |
| Methanol | 50 |
| Isopropanol | 20 |

(Formulation for charge generation layer coating liquid)

| | Parts by Weight |
|---|---|
| Oxytitanium phthalocyanine | 4 |
| Polyvinyl butyral | 1 |
| Cyclohexanone | 150 |
| Tetrahydrofuran | 100 |

(Formulation for charge transport layer coating liquid)

| | Parts by Weight |
|---|---|
| Charge transport material with the following formula: [Chemical Formula 10] | 8 |

-continued

| | Parts by Weight |
|---|---|
| 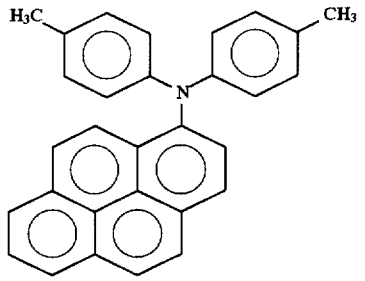 | |
| Polycarbonate | 10 |
| Tetrahydrofuran | 80 |

The absorption spectrum of the charge generation material and that of the charge transport material in a charged state were measured by the previously mentioned method. As a result, the charge generation material exhibited its absorption in the wavelength range of 540 to 880 nm. With the absorption spectrum of the charge generation material taken into consideration, the light to be applied to the surface of the photoconductor to form latent electrostatic images thereon was required to have a wavelength range of 540 to 880 nm at least.

Figure 15:
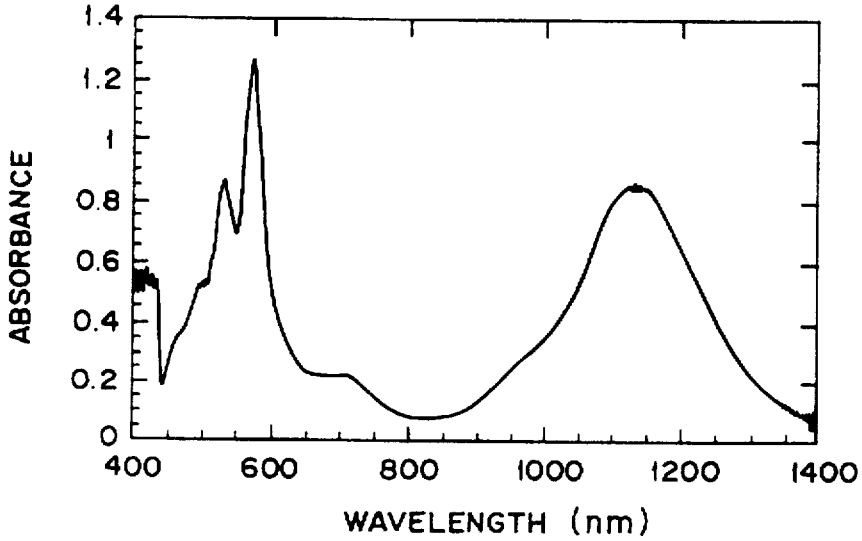
FIG. 15 is an absorption spectrum of a charge transport material in a charged state employed in Examples 35 and 36.

The absorption spectrum of the charge transport material in a charged state (in a cation radical state) is shown in FIG. 15. In FIG. 15, the wavelengths of three peaks, that is, $\lambda_A$, $\lambda_B$ and $\lambda_C$ are respectively 534 nm, 579 nm and 1138 nm. Further, one of the half-width wavelength values of the peak wavelength $\lambda_A$, that is, the wavelength $\lambda_a$ is 483 nm. It is impossible to measure the wavelength value $\lambda_b$. One of the half-width wavelength values of the peak wavelength $\lambda_B$, that is, the wavelength $\lambda_d$ is 597 nm. It is impossible to measure the wavelength value $\lambda_a$. The half-width wavelength values of the peak wavelength $\lambda_C$, that is, the wavelengths $\lambda_e$ and $\lambda_f$ are respectively 1026 nm and 1248 nm.

An electrophotographic apparatus of the present invention as shown in FIG. 2 was manufactured using the electrophotographic photoconductor No. 6. In this case, a semiconductor laser beam with a wavelength of 780 nm serving as the light source and a polygon mirror were employed for the image recording light exposure unit 24. For the light source of the quenching light exposure unit 28, a light emitting diode (LED) exhibiting an emission peak with a wavelength of 810 nm was employed.

In the thus prepared electrophotographic apparatus, the pre-cleaning light exposure unit 26 was not provided.

Further, a probe for an electrometer was inserted into a surface portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit as the photoconductor was drive in rotation. The above-mentioned surface potentials were measured after making one copy and 5,000 copies.

The results are shown in Table 11.

EXAMPLE 36

The procedure for manufacture of the electrophotographic apparatus as in Example 35 was repeated except that the LED exhibiting an emission peak with a wavelength of 810 nm as the light source for the quenching light exposure unit 29 in Example 35 was replaced by an LED exhibiting an emission peak with a wavelength of 630 nm.

Using the above electrophotographic apparatus, the surface potentials of a light-exposed portion and a non light-exposed portion of the photoconductor were measured in the same manner as in Example 35 after making one copy and 5,000 copies.

The results are shown in Table 11.

TABLE 11

| | Light for Image Recording Light Exposure | | Light for Quenching Light Exposure | | Surface Potential of Photoconductor (V) After making of one copy | | Surface Potential of Photoconductor (V) After making of 5,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 35 | *5 | *5 | 790(*7) | 830(*7) | 24 | 675 | 30 | 630 |
| Ex. 36 | *5 | *5 | 610(*3) | 645(*3) | 23 | 680 | 45 | 550 |

*3 Light emitting diode (LED) exhibiting an emission peak with a wavelength of 630 nm was employed.
*5 Semiconductor laser with a wavelength of 780 nm was employed.
*7 Light emitting diode (LED) exhibiting an emission peak with a wavelength of 810 nm was employed.

EXAMPLE 37

[Preparation of Electrophotographic Photoconductor]

A coating liquid for an undercoat layer was coated on an aluminum cylindrical drum serving as an electroconductive support and dried, so that an undercoat layer was provided on the electroconductive support. Then, a coating liquid for a charge generation layer and a coating liquid for a charge transport layer were successively coated on the undercoat layer and dried, so that a charge generation layer and a charge transport layer were successively overlaid on the undercoat layer. Thus, an electrophotographic photoconductor of a laminated type No. 7 was prepared.

Each formulation for the undercoat layer coating liquid, the charge generation layer coating liquid, or the charge transport layer coating liquid was as follows:

(Formulation for undercoat layer coating liquid)

| | Parts by Weight |
|---|---|
| Alcohol-soluble nylon | 5 |
| Methanol | 50 |
| Isopropanol | 20 |

(Formulation for charge generation layer coating liquid)

| | Parts by Weight |
|---|---|
| Charge generation material with the following formula: [Chemical Formula 11] | 5 |

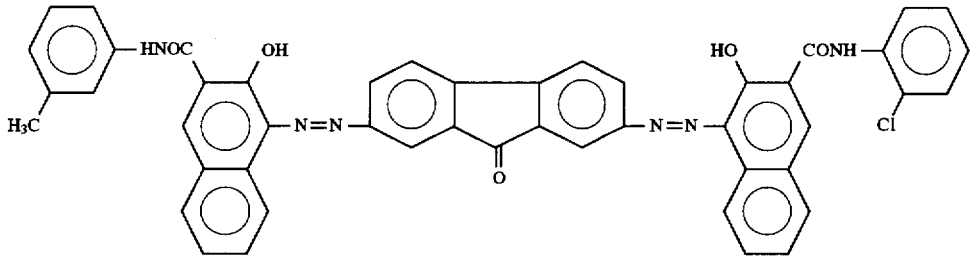

| | |
|---|---|
| Polyvinyl butyral | 3 |
| Tetrahydrofuran | 200 |
| 4-methyl-2-pentanone | 90 |

(Formulation for charge transport layer coating liquid)

| | Parts by Weight |
|---|---|
| Charge transport material with the following formula: [Chemical Formula 12] | 8 |

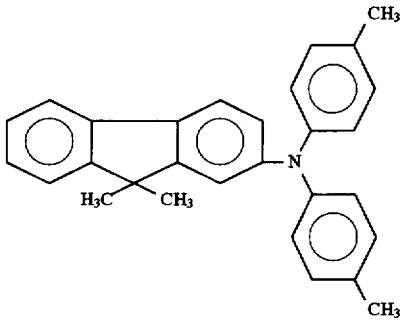

| | |
|---|---|
| Polycarbonate | 10 |
| Methylene chloride | 80 |

The absorption spectrum of the charge generation material and that of the charge transport material in a charged state were measured by the previously mentioned method. As at result, the charge generation material exhibited its absorption in the wavelength range of 400 to 680 nm. With the absorption spectrum of the charge generation material taken into consideration, the light to be applied to the surface of the photoconductor to form latent electrostatic images thereon was required to have a wavelength range of 400 to 680 nm at least.

Figure 16:
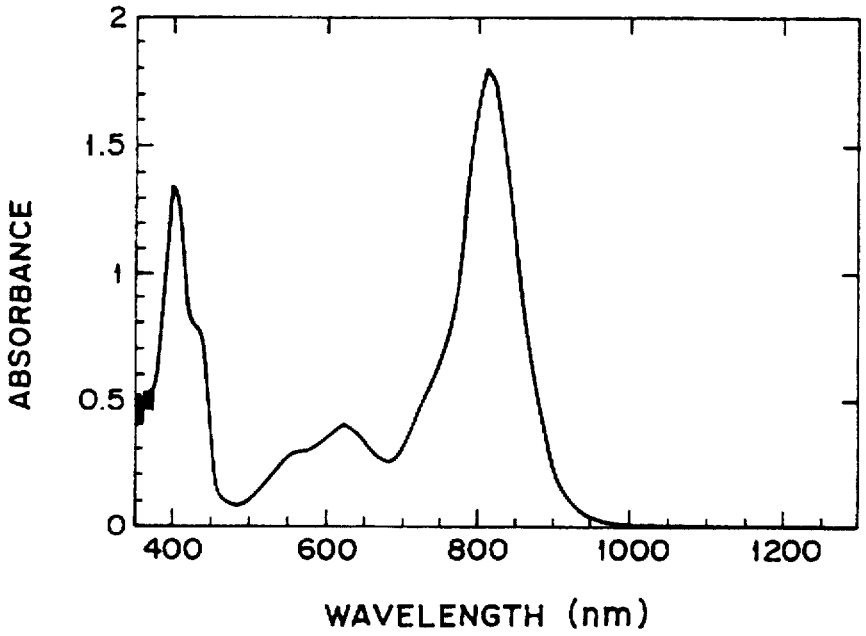
FIG. 16 is an absorption spectrum of a charge transport material in a charged state employed in Examples 37 and 38.

The absorption spectrum of the charge transport material in a charged state (in a cation radical state) is shown in FIG. 16. In FIG. 16, the wavelengths of three peaks, that is, $\lambda_A$, $\lambda_B$ and $\lambda_C$ are respectively 403 nm, 624 nm and 819 nm. Further, one of the half-width wavelength values of the absorption peak with a wavelength $\lambda_A$ in a longer wavelength region, that is, $\lambda_b$ is 442 nm. It is impossible to measure the wavelength value $\lambda_a$. The half-width wavelength values of the absorption peak with a wavelength $\lambda_a$, that is, $\lambda_c$ and $\lambda_d$ are respectively 527 nm and 680 nm. The half-width wavelength values of the absorption peak with a wavelength $\lambda_C$, that is, $\lambda_e$ and $\lambda_f$ are respectively 771 nm and 826 nm.

An electrophotographic apparatus of the present invention as shown in FIG. 1 was manufactured using the electrophotographic photoconductor No. 7. In this case, a tungsten lamp (white light) was used as the light source for the image recording light exposure unit 5. For the light source of the quenching light exposure unit 2, a light emitting diode (LED) exhibiting an emission peak with a wavelength of 670 nm was employed.

Further, a probe for an electrometer was inserted into a surface portion of the photoconductor to measure the surface potential of the photoconductor. The surface potentials of a light-exposed portion and a non-light-exposed portion of the photoconductor were measured by the electrometer when a latent electrostatic image formed on the photoconductor arrived at a position just before the developing unit as the photoconductor was drive in rotation. The above-mentioned surface potentials were measured after making one copy and 10,000 copies.

The results are shown in Table 12.

EXAMPLE 38

The procedure for manufacture of the electrophotographic apparatus as in Example 37 was repeated except that the LED exhibiting an emission peak with a wavelength of 670 nm as the light source for the quenching light exposure unit 2 in Example 37 was replaced by an Ar laser beam with a wavelength of 514.5 nm.

Using the above electrophotographic apparatus, the surface potentials of a light-exposed portion and a non light-exposed portion of the photoconductor were measured in the same manner as in Example 37 after making one copy and 10,000 copies.

The results are shown in Table 12.

COMPARATIVE EXAMPLE 18

The procedure for manufacture of the electrophotographic apparatus as in Example 37 was repeated except that the LED exhibiting an emission peak with a wavelength of 670 nm as the light source for the quenching light exposure unit 2 in Example 37 was replaced by an LED exhibiting an emission peak with a wavelength of 630 nm.

Using the above electrophotographic apparatus, the surface potentials of a light-exposed portion and a non light-exposed portion of the photoconductor were measured in the same manner as in example 37 after making one copy and 10,000 copies.

The results are shown in Table 12.

TABLE 12

| | Light for Image Recording Light Exposure | | Light for Quenching Light Exposure | | Surface Potential of Photoconductor (V) After making of one copy | | After making of 10,000 copies | |
|---|---|---|---|---|---|---|---|---|
| | $\lambda_1$(nm) | $\lambda_2$(nm) | $\lambda_1$(nm) | $\lambda_2$(nm) | Light-exposed portion | Non-exposed portion | Light-exposed portion | Non-exposed portion |
| Ex. 37 | *1 | *1 | 650(*9) | 690(*9) | 25 | 720 | 35 | 681 |
| Ex. 38 | *1 | *1 | *10 | *10 | 24 | 725 | 28 | 700 |
| Comp. Ex. 18 | *1 | *1 | 610(*3) | 645(*3) | 23 | 728 | 153 | 415 |

*1 Tungsten light without any filter.
*3 Light emitting diode (LED) exhibiting an emission peak with a wavelength of 630 nm was employed.
*9 Light emitting diode (LED) exhibiting an emission peak with a wavelength of 670 nm was employed.
*10 Ar laser with a wavelength of 514.5 nm was employed.

According to the present invention, the rays of light selected from type 1, type 2 and type 3 are applied to the surface of the photoconductor in at least one light-application stop throughout the electrophotographic process. Therefore, the electrostatic fatigue of the photoconductor, that is, the decrease of chargeability and the increase of residual potential can be effectively prevented when the photoconductor is repeatedly used for an extended period of time.

Japanese Patent Application 07-309752 filed Nov. 6, 1995 and Japanese Patent Application filed Oct. 24, 1996 are hereby incorporated by reference.

What is claimed is:

1. An electrophotographic process using an electrophotographic photoconductor comprising a photoconductive layer which comprises a charge generation material and a charge transport material, said charge transport material being convertible from a neutral state into a charged state during the photoconduction in said photoconductive layer, comprising the steps of:

charging said photoconductive layer so as to have a predetermined surface potential in the dark;

exposing said photoconductive layer with said predetermined surface potential to light images to form latent electrostatic images on said photoconductive layer;

developing said latent electrostatic images with a toner to visible toner images;

transferring said visible toner images to an image transfer sheet;

cleaning said photoconductive layer to remove residual toner particles from the surface of said photoconductive layer; and quenching residual charges from the surface of said photoconductive layer, wherein when light is applied to said photoconductive layer in the course of said electrophotographic process, at least one type of rays of light selected from type 1, type 2 and type 3 is employed:

type 1: rays of light having a light emission peak, with a half-width wavelength range thereof being free from the overlapping of a peak wavelength of an absorption light of said charge transport material in said charged state;

type 2: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond the wavelength of a rightmost absorption peak of an absorption light of said charge transport material in said charged state; and type 3: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond the wavelength of a leftmost absorption peak of an absorption light of said charge transport material in said charged state, in a wavelength range free from the overlapping of the light absorption of said charge transport material in said neutral state and the light absorption of said charge transport material in said charged state.

2. The electrophotographic process as claimed in claim 1, wherein said rays of light are substantially free from said absorption light of said charge transport material in said charged state.

3. The electrophotographic process as claimed in claim 1, wherein said rays of light of type 1 are coherent.

4. The electrophotographic process as claimed in claim 1, wherein at least one type of rays of light selected from said type 1, type 2 and type 3 is employed in at least one of said step of exposing said photoconductive layer with said predetermined surface potential to light images or said step of quenching residual charges from the surface of said photoconductive layer.

5. An electrophotographic process using an electrophotographic photoconductor comprising a photoconductive layer which comprises a charge generation material and a charge transport material, said charge transport material being convertible from a neutral state into a charged state during the photoconduction in said photoconductive layer, and comprising at least one step of applying light to said photoconductive layer in the course of said electrophotographic process, wherein at least one type of rays of light selected from type 1, type 2 and type 3 is employed:

type 1: rays of light having a light emission peak, with a half-width wavelength range thereof being free from the overlapping of a peak wavelength of an absorption light of said charge transport material in said charged state;

type 2: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond the wavelength of a rightmost absorption peak of an absorption light of said charge transport material in said charged state; and type 3: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond the wavelength of a leftmost absorption peak of an absorption light of said charge transport material in said charged state, in a wavelength range free from the overlapping of the light absorption of said charge transport material in said neutral state and the light absorption of said charge transport material in said charged state.

6. The electrophotographic process as claimed in claim 5, wherein said rays of light are substantially free from said absorption light of said charge transport material in said charged state.

7. The electrophotographic process as claimed in claim 5, wherein said rays of light of type 1 are coherent.

8. The electrophotographic process as claimed in claim 5, wherein said photoconductive layer is charged so as to have a predetermined surface potential in the dark, and then exposed to light images to form latent electrostatic images thereon, said latent electrostatic images are developed with a toner to visible toner images, said visible toner images are transferred to an image transfer sheet, said photoconductive layer is cleaned to remove residual toner particles from the surface of said photoconductive layer, and residual charges are quenched from the surface of said photoconductive layer, and at least one type of rays of light selected from said type 1, type 2 and type 3 is employed at least when said photoconductive layer having said predetermined surface potential is exposed to light images to form latent electrostatic images thereon, or when said residual charges are quenched from the surface of said photoconductive layer.

9. An electrophotographic process using an electrophotographic photoconductor comprising a photoconductive layer which comprises a charge generation material and a charge transport material, said charge transport material being convertible from a neutral state into a charged state during the photoconduction in said photoconductive layer, comprising the steps of:

charging said photoconductive layer so as to have a predetermined surface potential in the dark;

exposing said photoconductive layer with said predetermined surface potential to light images to form latent electrostatic images on said photoconductive layer;

developing said latent electrostatic images with a toner to visible toner images;

transferring said visible toner images to an image transfer sheet;

cleaning said photoconductive layer to remove residual toner particles from the surface of said photoconductive layer; and quenching residual charges from the surface of said photoconductive layer, wherein when light is applied to said photoconductive layer in the course of said electrophotographic process, at least one type of rays of light selected from type 1a, type 2a and type 3a in employed:

type 1a: rays of light having a light emission peak, with a half-width wavelength range thereof being free from the overlapping of a half-width wavelength range of a peak wavelength of an absorption light of said charge transport material in said charged state;

type 2a: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond a half-width wavelength range of a rightmost absorption peak of an absorption light of said charge transport material in said charged state; and type 3a: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond a half-width wavelength range of a leftmost absorption peak of an absorption light of said charge transport material in said charged state, in a wavelength range free from the overlapping of the light absorption of said charge transport material in said neutral state and the light absorption of said charge transport material in said charged state.

10. The electrophotographic process as claimed in claim 9, wherein said rays of light are substantially free from said absorption light of said charge transport material in said charged state.

11. The electrophotographic process as claimed in claim 9, wherein said rays of light of type 1a are coherent.

12. The electrophotographic process as claimed in claim 9, wherein at least one type of rays of light selected from said type 1a, type 2a and type 3a is employed in at least one of said step of exposing said photoconductive layer with said predetermined surface potential to light images or said step of quenching residual charges from the surface of said photoconductive layer.

13. An electrophotographic process using an electrophotographic photoconductor comprising a photoconductive layer which comprises a charge generation material and a charge transport material, said charge transport material being convertible from a neutral state into a charged state during the photoconduction in said photoconductive layer, and comprising at least one step of applying light to said photoconductive layer in the course of said electrophotographic process, wherein at least one type of rays of light selected from type 1a, type 2a and type 3a is employed:

type 1a: rays of light having a light emission peak, with a half-width wavelength range thereof being free from the overlapping of a half-width wavelength range of a peak wavelength of an absorption light of said charge transport material in said charged state;

type 2a: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond a half-width wavelength range of a rightmost absorption peak of an absorption light of said charge transport material in said charged state; and type 3a: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond a half-width wavelength range of a leftmost absorption peak of an absorption light of said charge transport material in said charged state, in a wavelength range free from the overlapping of the light absorption of said charge transport material in said neutral state and the light absorption of said charge transport material in said charged state.

14. The electrophotographic process as claimed in claim 13, wherein said rays of light are substantially free from said absorption light of said charge transport material in said charged state.

15. The electrophotographic process as claimed in claim 13, wherein said rays of light of type 1a are coherent.

16. The electrophotographic process as claimed in claim 13, wherein said photoconductive layer is charged so as to have a predetermined surface potential in the dark, and then exposed to light images to form latent electrostatic images thereon, said latent electrostatic images are developed with a toner to visible toner images, said visible toner images are transferred to an image transfer sheet, said photoconductive layer is cleaned to remove residual toner particles from the surface of said photoconductive layer, and residual charges are quenched from the surface of said photoconductive layer, and at least one type of rays of light selected from said type 1a, type 2a and type 3a is employed at least when said photoconductive layer having said predetermined surface potential is exposed to light images to form latent electrostatic images thereon, or when said residual charges are quenched from the surface of said photoconductive layer.

17. An electrophotographic apparatus comprising:

an electrophotographic photoconductor comprising a photoconductive layer which comprises a charge generation material and a charge transport material, said charge transport material being convertible from a neutral state into a charged state during the photoconduction in said photoconductive layer, charging means for charging said photoconductive layer so as to have a predetermined surface potential in the dark, exposure means for exposing said photoconductive layer with said predetermined surface potential to light images to form latent electrostatic images on said photoconductive layer, developing means for developing said latent electrostatic images with a toner to visible toner images, image transfer means for transferring said visible toner images to an image transfer sheet, cleaning means for cleaning said photoconductive layer to remove residual toner particles from the surface of said photoconductive layer, and quenching means for quenching residual charges from the surface of said photoconductive layer, wherein when light is applied to said photoconductive layer in said electrophotographic apparatus, at least one type of rays of light selected from type 1, type 2 and type 3 is employed:

type 1: rays of light having a light emission peak, with a half-width wavelength range thereof being free from the overlapping of a peak wavelength of an absorption light of said charge transport material in said charged state;

type 2: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond the wavelength of a rightmost absorption peak of an absorption light of said charge transport material in said charged state; and type 3: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond the wavelength of a leftmost absorption peak of an absorption light of said charge transport material in said charged state, in a wavelength range free from the overlapping of the light absorption of said charge transport material in said neutral state and the light absorption of said charge transport material in said charged state.

18. The electrophotographic apparatus as claimed in claim 17, wherein said rays of light are substantially free from said absorption light of said charge transport material in said charged state.

19. The electrophotographic apparatus as claimed in claim 17, wherein said rays of light of type 1 are coherent.

20. The electrophotographic apparatus as claimed in claim 17, wherein at least one type of rays of light selected from said type 1, type 2 and type 3 is employed in at least one of said exposure means for exposing said photoconductive layer with said predetermined surface potential to light images or said quenching means for quenching residual charges from the surface of said photoconductive layer.

21. An electrophotographic apparatus comprising an electrophotographic photoconductor comprising a photoconductive layer which comprises a charge generation material and a charge transport material, said charge transport material being convertible from a neutral state into a charged state during the photoconduction in said photoconductive layer, and at least one light-application means for applying light to said photoconductive layer, wherein at least one type of rays of light selected from type 1, type 2 and type 3 is employed:

type 1: rays of light having a light emission peak, with a half-width wavelength range thereof being free from the overlapping of a peak wavelength of an absorption light of said charge transport material in said charged state;

type 2: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond the wavelength of a rightmost absorption peak of an absorption light of said charge transport material in said charged state; and type 3: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond the wavelength of a leftmost absorption peak of an absorption light of said charge transport material in said charged state, in a wavelength range free from the overlapping of the light absorption of said charge transport material in said neutral state and the light absorption of said charge transport material in said charged state.

22. The electrophotographic apparatus as claimed in claim 21, wherein said rays of light are substantially free from said absorption light of maid charge transport material in said charged state.

23. The electrophotographic apparatus am claimed in claim 21, wherein said rays of light of type 1 are coherent.

24. An electrophotographic apparatus comprising:

an electrophotographic photoconductor comprising a photoconductive layer which comprises a charge generation material and a charge transport material, said charge transport material being convertible from a neutral state into a charged state during the photoconduction in said photoconductive layer, charging means for charging said photoconductive layer so as to have a predetermined surface potential in the dark, exposure means for exposing said photoconductive layer with said predetermined surface potential to light images to form latent electrostatic images on said photoconductive layer, developing means for developing said latent electrostatic images with a toner to visible toner images, image transfer means for transferring said visible toner images to an image transfer sheet, cleaning means for cleaning said photoconductive layer to remove residual toner particles from the surface of said photoconductive layer, and quenching means for quenching residual charges from the surface of said photoconductive layer, wherein when light is applied to said photoconductive layer in said electrophotographic apparatus, at least one type of rays of light selected from type 1a, type 2a and type 3a is employed:

type 1a: rays of light having a light emission peak, with a half-width wavelength range thereof being free from the overlapping of a half-width wavelength range of a peak wavelength of an absorption light of said charge transport material in said charged state;

type 2a: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond a half-width wavelength range of a rightmost absorption peak of an absorption light of said charge transport material in said charged state; and type 3a: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond a half-width wavelength range of a leftmost absorption peak of an absorption light of said charge transport material in said charged state, in a wavelength range free from the overlapping of the light absorption of said charge transport material in said neutral state and the light absorption of said charge transport material in said charged state.

25. The electrophotographic apparatus as claimed in claim 24, wherein said rays of light are substantially free from said absorption light of said charge transport material in said charged state.

26. The electrophotographic apparatus as claimed in claim 24, wherein said rays of light of type 1a are coherent.

27. The electrophotographic apparatus as claimed in claim 24, wherein at least one type of rays of light selected from said type 1a, type 2a and type 3a is employed in at least one of said exposure means for exposing said photoconductive layer with said predetermined surface potential to light images or said quenching means for quenching residual charges from the surface of said photoconductive layer.

28. An electrophotographic apparatus comprising:

an electrophotographic photoconductor comprising a photoconductive layer which comprises a charge generation material and a charge transport material, said charge transport material being convertible from a neutral state into a charged state during the photoconduction in said photoconductive layer, and at least one light-application means for applying light to said photoconductive layer, wherein at least one type of rays of light selected from type 1a, type 2a and type 3a is employed:

type 1a: rays of light having a light emission peak, with a half-width wavelength range thereof being free from the overlapping of a half-width wavelength range of a peak wavelength of an absorption light of said charge transport material in said charged state;

type 2a: rays of light with a continuous spectrum having a threshold wavelength value, with the light emission components thereof being present on a longer wavelength side than said threshold wavelength value, and on a scale with the wavelength increasing in the right direction, a half value of said threshold wavelength value being on a longer wavelength side beyond a half-width wavelength range of a rightmost absorption peak of an absorption light of said charge transport material in said charged state; and type 3a: rays of light with a continuous spectrum having a threshold wavelength value, with the light emission components thereof being present on a shorter wavelength side than said threshold wavelength value, and on a scale with the wavelength decreasing in the left direction, a half value of said threshold wavelength value being on a shorter wavelength side beyond a half-width wavelength range of a leftmost absorption peak of an absorption light of said charge transport material in said charged state, in a wavelength range free from the overlapping of the light absorption of said charge transport material in said neutral state and the light absorption of said charge transport material in said charged state.

29. The electrophotographic apparatus as claimed in claim 28, wherein said rays of light are substantially free from said absorption light of said charge transport material in said charged state.

30. The electrophotographic apparatus as claimed in claim 28, wherein said rays of light of type 1a are coherent.

* * * * *

UNITED STATES PATENT AND TRADEMARK OFFICE

CERTIFICATE OF CORRECTION

PATENT NO. : 5,749,029
DATED : MAY 5, 1998
INVENTOR(S) : MINORU UMEDA

It is certified that error appears in the above-identified patent and that said Letters Patent is hereby corrected as shown below:

Column 6, line 26 "in" should read --is--.

Column 7, line 17 "stop" should read --step--.

Column 8, line 64 "retain." should read --resin.--.

Column 8, line 65 "rosin" should read --resin--.

Column 10, line 65 delete "the" between be and best.

Column 16, line 15 "drive" should read --driven--.

UNITED STATES PATENT AND TRADEMARK OFFICE

CERTIFICATE OF CORRECTION

PATENT NO. : 5,749,029
DATED : MAY 5, 1998
INVENTOR(S) : MINORU UMEDA

It is certified that error appears in the above-identified patent and that said Letters Patent is hereby corrected as shown below:

Column 19, line 27 delete ":"

Column 20, line 6 "1022 nm" should read --1022 nm.--.

Column 20, line 31 "drive" should read --driven--.

Column 20, line 45 "face" should read --surface--.

Column 24, line 46 "drive" should read --driven--.

Column 24, line 58 "filter" should read --filters--.

UNITED STATES PATENT AND TRADEMARK OFFICE

CERTIFICATE OF CORRECTION

PATENT NO. : 5,749,029
DATED : MAY 5, 1998
INVENTOR(S) : MINORU UMEDA

It is certified that error appears in the above-identified patent and that said Letters Patent is hereby corrected as shown below:

Column 27, line 46 delete ":"

Column 27, line 65 "drive" should read --driven--.

Column 32, line 39 "drive" should read --driven--.

Column 36, line 11 "drive" should read --driven--.

Column 36, line 22 "29" should read --28--.

Column 38, line 47 "drive" should read --driven--.

UNITED STATES PATENT AND TRADEMARK OFFICE

CERTIFICATE OF CORRECTION

PATENT NO. : 5,749,029
DATED : MAY 5, 1998
INVENTOR(S) : MINORU UMEDA

It is certified that error appears in the above-identified patent and that said Letters Patent is hereby corrected as shown below:

Column 45, line 32 "maid" should read --said--.

Column 45, line 34 "am" should read --as--.

Signed and Sealed this

Second Day of February, 1999

*Attest:*

*Attesting Officer*

*Acting Commissioner of Patents and Trademarks*